US009839819B2

(12) United States Patent
Mizutani et al.

(10) Patent No.: US 9,839,819 B2
(45) Date of Patent: Dec. 12, 2017

(54) GOLF CLUB HEAD CROWN WITH RECESS PART AND STEP SURFACE

(71) Applicant: DUNLOP SPORTS CO. LTD., Kobe-shi, Hyogo (JP)

(72) Inventors: Naruhiro Mizutani, Kobe (JP); Phil Seagram, Huntington Beach, CA (US); Keith Dolezel, Huntington Beach, CA (US); Mika Becktor, Huntington Beach, CA (US)

(73) Assignee: DUNLOP SPORTS CO. LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/132,730

(22) Filed: Apr. 19, 2016

(65) Prior Publication Data

US 2017/0050093 A1 Feb. 23, 2017

Related U.S. Application Data

(60) Provisional application No. 62/207,211, filed on Aug. 19, 2015.

(51) Int. Cl.

| | |
|---|---|
| ***A63B 53/02*** | (2015.01) |
| ***A63B 53/04*** | (2015.01) |
| ***A63B 60/52*** | (2015.01) |

(52) U.S. Cl.

CPC ..... *A63B 53/0466* (2013.01); *A63B 60/52* (2015.10); *A63B 2053/0408* (2013.01); *A63B 2053/0437* (2013.01)

(58) Field of Classification Search

CPC ..... A63B 53/02
USPC ..... 473/324, 327
See application file for complete search history.

(56) References Cited

U.S. PATENT DOCUMENTS

| | | | | | |
|---|---|---|---|---|---|
| 4,900,029 | A * | 2/1990 | Sinclair | A63B 53/04 | 473/327 |
| 5,092,599 | A * | 3/1992 | Okumoto | A63B 53/04 | 473/327 |
| 5,221,086 | A * | 6/1993 | Antonious | A63B 53/04 | 473/327 |
| D356,130 | S * | 3/1995 | Schield | D21/733 | |
| D363,100 | S * | 10/1995 | Long | D21/733 | |
| 5,511,786 | A * | 4/1996 | Antonious | A63B 53/04 | 473/327 |
| 5,518,242 | A * | 5/1996 | Mahaffey | A63B 53/04 | 473/342 |
| D418,885 | S * | 1/2000 | Wanchena | D21/733 | |
| 6,139,446 | A * | 10/2000 | Wanchena | A63B 53/04 | 473/328 |
| 6,319,148 | B1 * | 11/2001 | Tom | A63B 53/00 | 473/290 |
| D470,203 | S * | 2/2003 | Rollinson | D21/733 | |
| D470,552 | S * | 2/2003 | Cleveland | D21/733 | |

(Continued)

*Primary Examiner* — William Pierce

(74) *Attorney, Agent, or Firm* — Birch, Stewart, Kolasch & Birch, LLP

(57) ABSTRACT

A head h1 includes a crown c1, a sole s1, a face f1 and a hosel h1. The crown c1 includes a recess part RE1, a back part 100 positioned at a back of the recess part RE1, and a step surface ST1 positioned at a front of the back part 100 and positioned above a virtual extension surface HF1 of the back part 100. At least a part of the recess part RE1 extends in a toe-heel direction. At least a part of the step surface ST1 extends in the toe-heel direction. At least a part of the recess part RE1 may extend in a front-back direction.

5 Claims, 34 Drawing Sheets

(56) References Cited

U.S. PATENT DOCUMENTS

D484,937 S * 1/2004 Madore ..... D21/742
D502,973 S * 3/2005 Gillig ..... D21/736
D502,974 S * 3/2005 Gillig ..... D21/742
D503,443 S * 3/2005 Gillig ..... D21/733
D503,444 S * 3/2005 Gillig ..... D21/736
D508,272 S * 8/2005 Gillig ..... D21/736
7,128,660 B2 * 10/2006 Gillig ..... A63B 53/0466 473/324
D532,470 S * 11/2006 Oldknow ..... D21/752
D532,853 S * 11/2006 Oldknow ..... D21/752
D543,600 S * 5/2007 Oldknow ..... D21/759
7,470,200 B2 * 12/2008 Sanchez ..... A63B 53/0466 473/328
D584,369 S * 1/2009 Hooley ..... D21/733
7,641,568 B2 * 1/2010 Hoffman ..... A63B 53/0466 473/327
7,651,414 B2 * 1/2010 Rae ..... A63B 53/0466 473/346
8,241,144 B2 8/2012 Albertsen et al.
8,591,351 B2 11/2013 Albertsen et al.
8,758,164 B2 * 6/2014 Breier ..... A63B 53/0466 473/332
8,821,312 B2 9/2014 Burnett et al.
8,834,289 B2 9/2014 de la Cruz et al.
2007/0232408 A1 * 10/2007 Horacek ..... A63B 53/0466 473/324
2008/0051215 A1 * 2/2008 Rae ..... A63B 53/0466 473/345
2012/0289361 A1 * 11/2012 Beach ..... A63B 53/04 473/338
2013/0029783 A1 * 1/2013 Kimizuka ..... A63B 53/0466 473/345
2013/0184100 A1 * 7/2013 Burnett ..... A63B 53/04 473/345
2013/0324295 A1 * 12/2013 Oldknow ..... A63B 53/0466 473/327
2014/0274448 A1 * 9/2014 Willett ..... A63B 53/04 473/327
2015/0072803 A1 3/2015 Golden et al.
2015/0094161 A1 * 4/2015 Stokke ..... A63B 53/0466 473/324
2015/0231455 A1 * 8/2015 Burnett ..... A63B 53/0475 473/345

* cited by examiner

GOLF CLUB HEAD CROWN WITH RECESS PART AND STEP SURFACE

The present application claims priority on Provisional Patent Application No. 62/207,211 filed in the United States on Aug. 19, 2015, the entire contents of which are hereby incorporated by reference.

BACKGROUND OF THE INVENTION

Field of the Invention

The present invention relates to a golf club head.

Description of the Related Art

A wood type golf club head having a groove on a crown or a sole thereof has been known. U.S. Pat. Nos. 8,241,144, 8,821,312 and 8,591,351 disclose a head having a stress reducing feature as a groove. U.S. Pat. No. 8,834,289 discloses a head having a flexure as a groove. JP2015-54241 (US2015/0072803) discloses a golf club head in which at least one of a crown portion, a sole portion, and a skirt portion includes a recess-part transition region.

SUMMARY OF THE INVENTION

From various standpoints, a further improved head has been desired. Inventors of the present application have found a new structure for a crown to be effective from a new standpoint.

It is an objective of the present invention to provide a golf club head capable of improving various performances based on a structure of a crown.

A preferable golf club head includes a crown, a sole, a face and a hosel. The crown includes a recess part, a back part positioned at a back of the recess part, and a step surface positioned at a front of the back part and positioned above a virtual extension surface of the back part. At least a part of the recess part extends in a toe-heel direction. At least a part of the step surface extends in the toe-heel direction.

Preferably, the recess part includes a first side surface positioned on a face side, and a second side surface positioned on a back side. Preferably, the step surface is continuous with the first side surface.

Preferably, a distance T between the step surface and the face is equal to or greater than 5 mm.

Preferably, a filler is disposed inside the recess part.

A preferable golf club includes the head. The golf club has a length of L inches and a real loft of R degrees. The recess part has a depth of D mm. The step surface has a height of H mm. When R/L is defined as X, and D×H is defined as Y, the golf club satisfies the following.

(1) X is equal to or greater than 0.1 but equal to or less than 0.9.

(2) Y is greater than 0 but equal to or less than 25.

Another preferable golf club head includes a crown, a sole, a face and a hosel. The crown has a back part, a step surface positioned at a front of the back part and positioned above a virtual extension surface of the back part, and a recess part extending in a front-back direction. The recess part intersects the step surface.

In the present invention, it is possible to obtain a golf club head having various performances improved by a structure of the crown.

BRIEF DESCRIPTION OF THE DRAWINGS

FIG. 6 is a partial cross-sectional view of a crown;

FIG. 13 shows a cross-sectional view of only a crown;

FIG. 14 is a partial cross-sectional view of a crown;

FIG. 15 is a partial cross-sectional view of a crown;

FIG. 16 is a partial cross-sectional view of a crown;

FIG. 17 is a partial cross-sectional view of a crown;

FIG. 27 is a partial cross-sectional view of a crown;

FIG. 32 is a partial cross-sectional view of a crown, and FIG. 32 includes a cross-sectional view of a recess part RE1 extending in a front-back direction;

DESCRIPTION OF THE PREFERRED EMBODIMENTS

Hereinafter, the present invention will be described in detail according to the preferred embodiments with appropriate references to the accompanying drawings.

Figure 1:
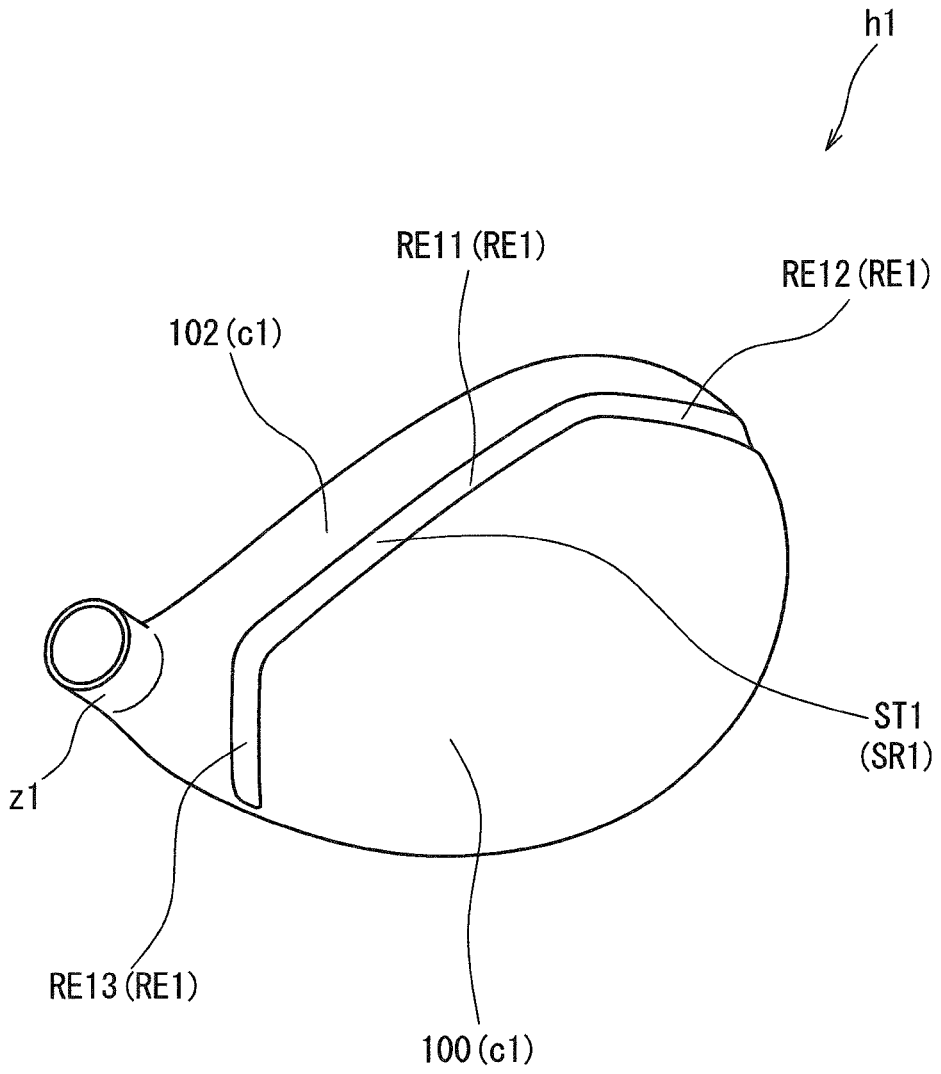
FIG. 1 shows a perspective view of a golf club head according to a first embodiment.
Figure 2:
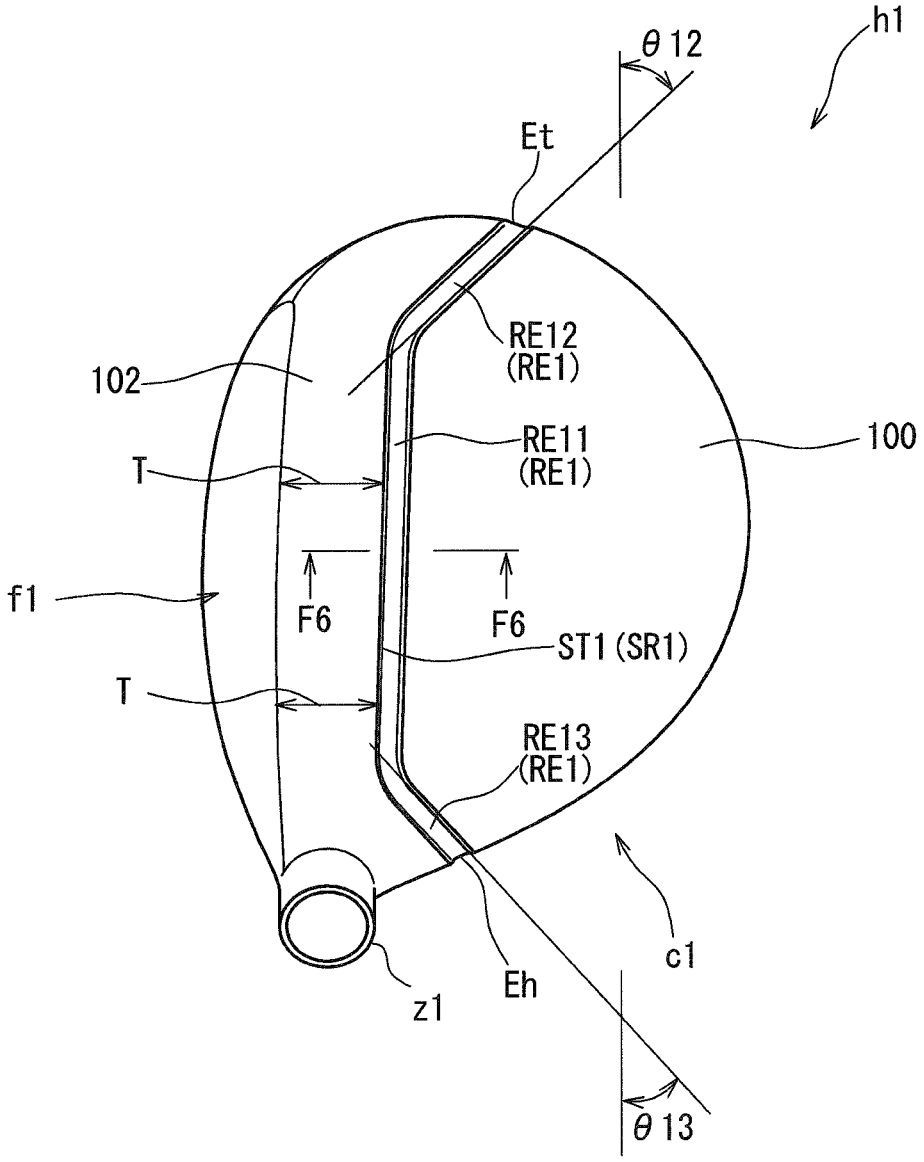
FIG. 2 shows a plan view of the head in FIG. 1.
Figure 3:
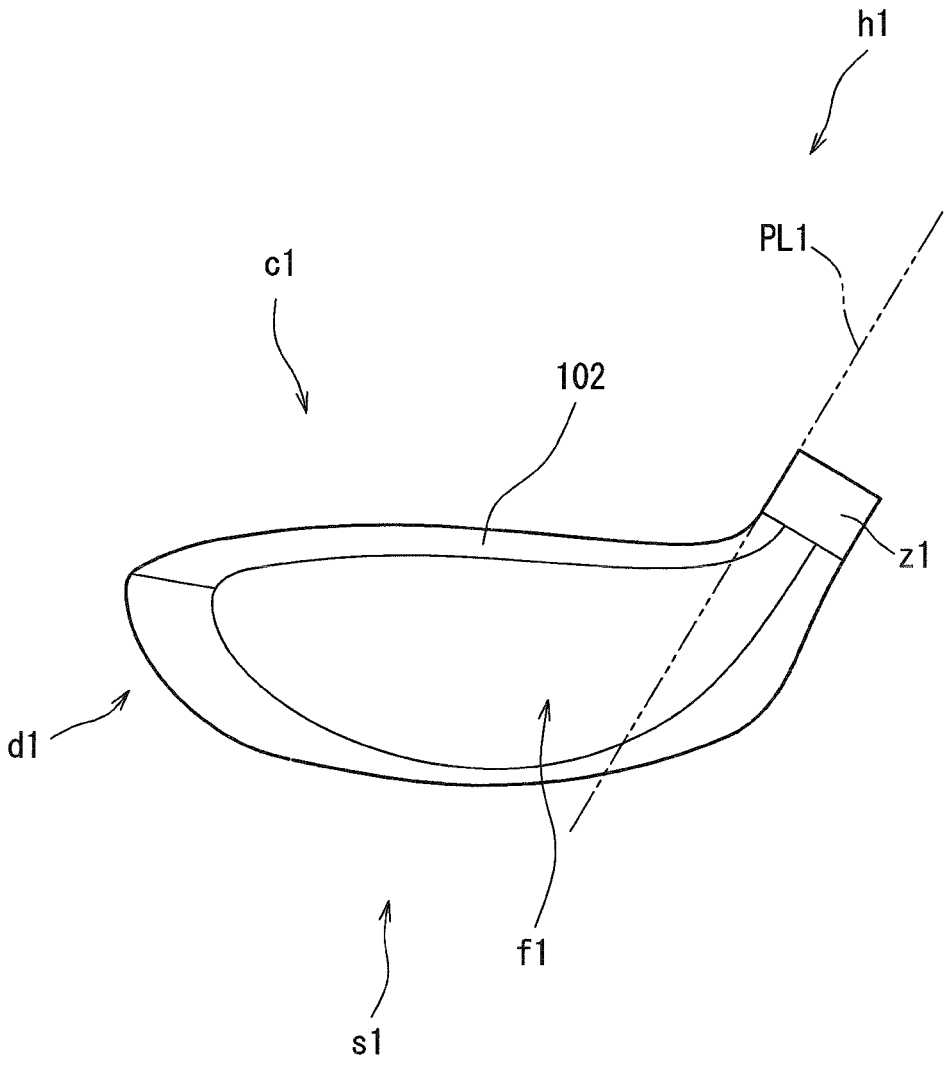
FIG. 3 shows a front view of the head in FIG. 1.
Figure 4:
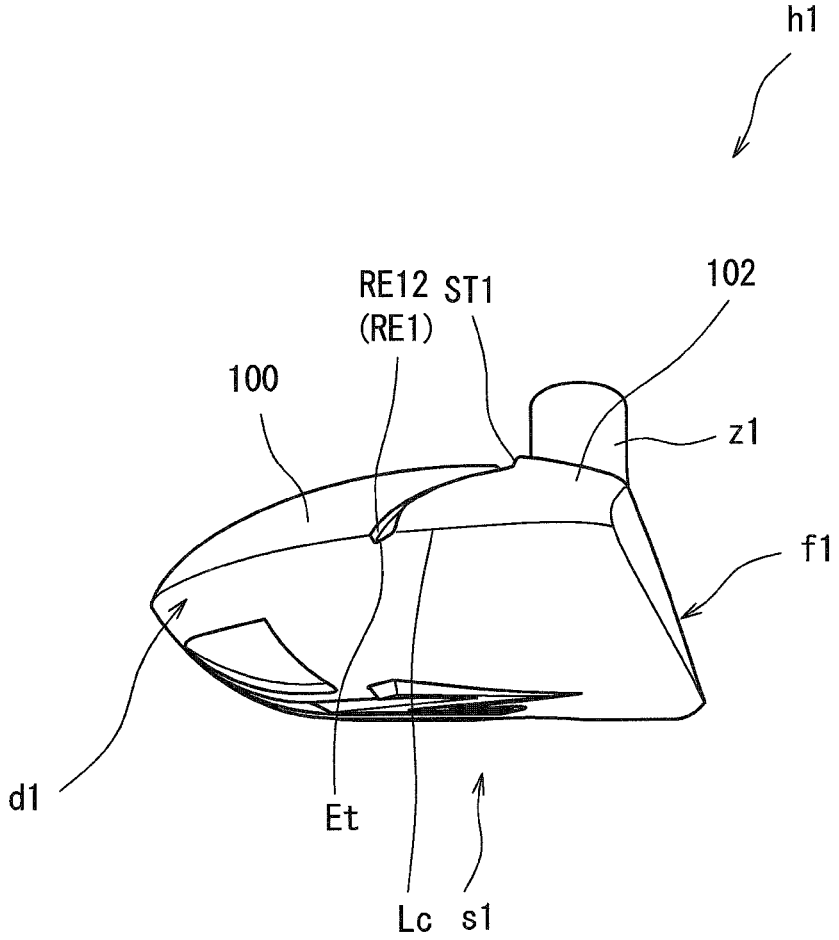
FIG. 4 shows a toe-side view of the head in FIG. 1.
Figure 5:
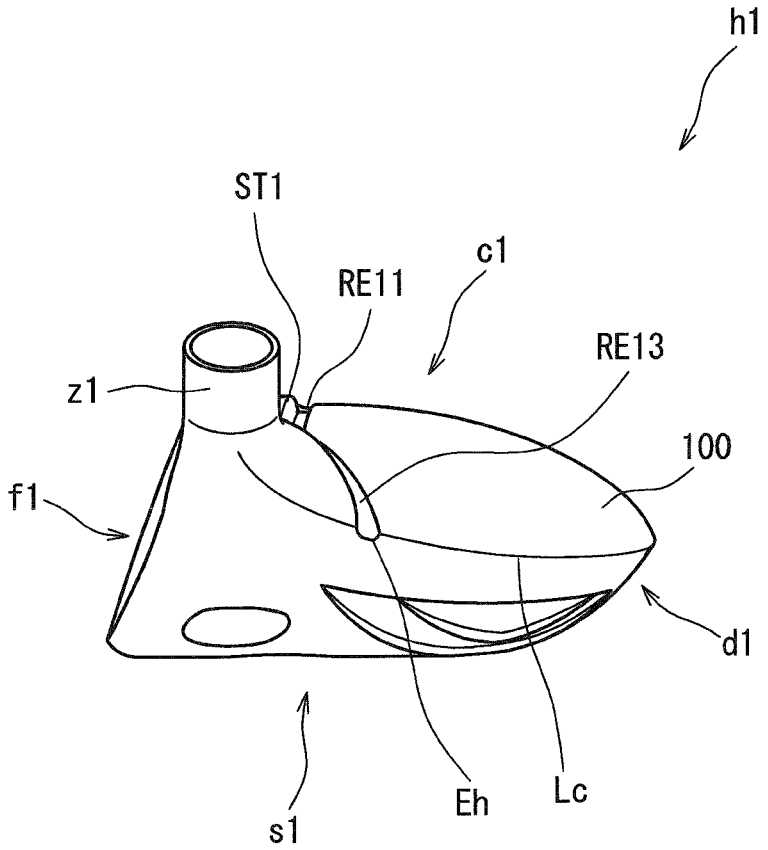
FIG. 5 shows a heel-side view of the head in FIG. 1.
Figure 6:
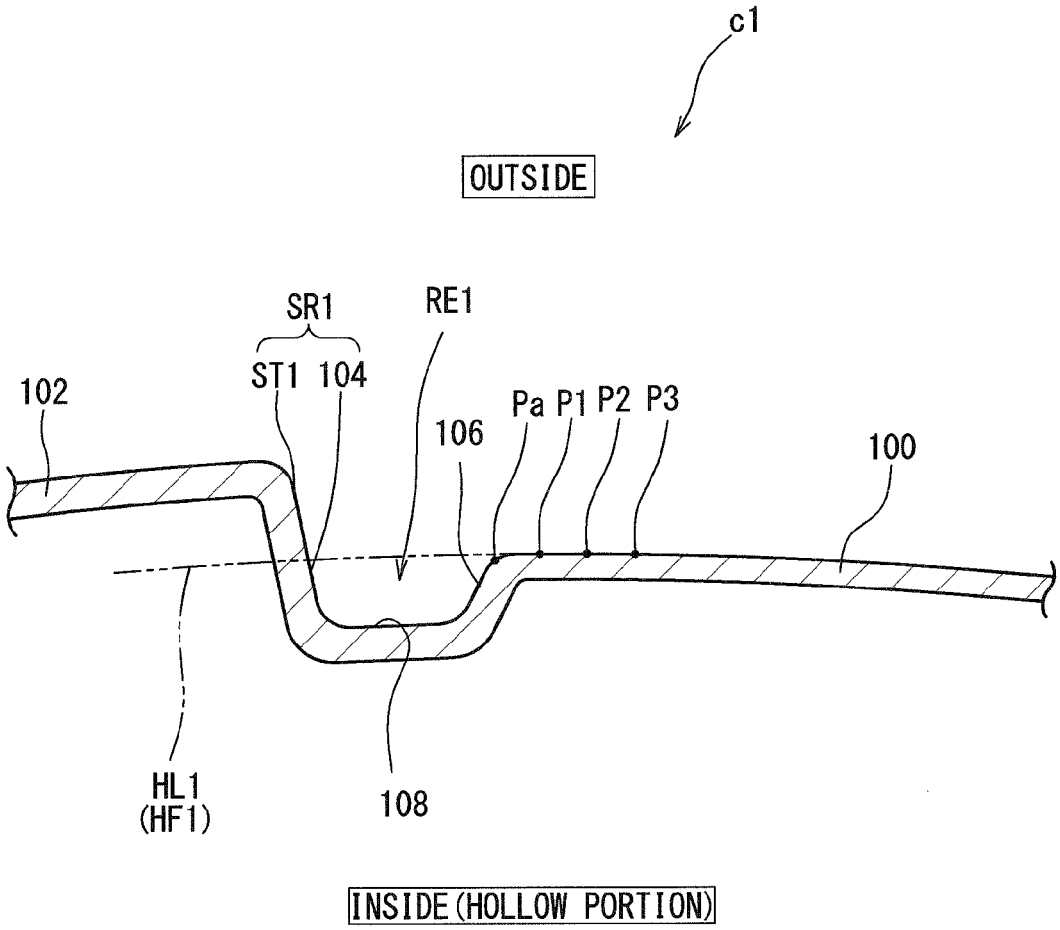
FIG. 6 shows a cross-sectional view taken along line F6-F6 in FIG. 2.

FIG. 1 is a perspective view of a head h1. FIG. 2 is a plan view of the head h1. The plan view is a figure viewed from a crown side. FIG. 3 is a front view of the head h1. The front view is a figure viewed from a face side. FIG. 4 is a side view of a toe side of the head h1. FIG. 5 is a side view of a heel side of the head h1. FIG. 6 is a cross-sectional view taken along line F6-F6 in FIG. 2.

The head h1 is a wood type head. The head h1 is a so-called fairway wood type. Inside of the head h1 is hollow. In other words, the head h1 has a hollow structure.

The head h1 includes a crown c1, a sole s1, a hosel z1 and a face f1. The crown c1 extends from an upper edge of the face f1 toward a back side. The sole s1 extends from a lower edge of the face f1 toward the back side. The outer surface of the face f1 is a hitting face. The hitting face is also referred to as a face surface.

The head h1 further includes a side part d1. The side part d1 extends between the crown c1 and the sole s1. The side part d1 is also referred to as a skirt.

[Definition of Terms]

The following terms are defined in the present application.

[A Reference State, A Reference Vertical Plane]

A state where a head is placed on a horizontal plan H with a prescribed lie angle and a prescribed real loft angle is defined as a reference state (not shown in the drawings). In the reference state, the center axial line of a shaft hole is contained in a plane perpendicular to the horizontal plane H. The perpendicular plane is defined as a reference vertical plane. The prescribed lie angle and real loft angle are appeared, for example, in a product catalog.

[Toe-heel Reference Direction]

A toe-heel reference direction denotes a direction of an intersection line of the reference vertical plane and the horizontal plane H.

[Toe-heel Direction]

A toe-heel direction denotes a direction having an angle with respect to the toe-heel reference direction of within ±20°. A preferable toe-heel direction has an angle with respect to the toe-heel reference direction of within ±10°. These angles are measured on a planar view seen from above. FIG. 2 is an example of the planar view.

[Front-back reference direction]

A front-back reference direction denotes a direction perpendicular to the toe-heel reference direction and parallel to the horizontal plane H.

[Front-back Direction]

A front-back direction denotes a direction having an angle with respect to the front-back reference direction of within ±20°. A preferable front-back direction has an angle with respect to the front-back reference direction of within ±10°. These angles are measured at the planar view seen from above.

[Up-down Direction]

An up-down direction denotes a direction perpendicular to the horizontal plane H.

[Planar View]

In the reference state, an image projected to a plane parallel to the horizontal plane H is the planar view. The direction of the projection is a direction perpendicular to the horizontal plane H.

[Face Center Fc]

A face center fc is defined as a centroid of the contour shape of the face surface. The contour shape is a projected image obtained by projecting the contour line of the face surface to a plane. The plane to be projected is a plane perpendicular to a line connecting a center of gravity of the head and a sweet spot. The sweet spot is an intersection point of the face surface and a perpendicular line drawn from the center of gravity of the head to the face surface. The perpendicular line is a normal line of the face surface.

[FW Category]

"FW category" is defined as an original term of the present application. A club belonging to FW category satisfies the following specifications (1a) to (1e).

(1a) The head has a curved face surface.

(1b) The head has a hollow part.

(1c) The head has a volume of equal to or greater than 130 cc but equal to or less than 300 cc.

(1d) The head has a real loft of equal to or greater than 14 degrees but equal to or less than 33 degrees.

(1e) The club has a length of equal to or greater than 39.0 inches but equal to or less than 43.5 inches.

The specifications for FW category are typical specifications for a so-called fairway wood.

[HB Category]

"HB category" is defined as an original term of the present application. A club belonging to HB category satisfies the following specifications (2a) to (2e).

(2a) The head has a curved face surface.

(2b) The head has a hollow part.

(2c) The head has a volume of equal to or greater than 90 cc but less than 130 cc.

(2d) The head has a real loft of equal to or greater than 15 degrees but equal to or less than 33 degrees.

(2e) The club has a length of equal to or greater than 37.0 inches but equal to or less than 41.5 inches.

The specifications for HB category are typical specifications for a so-called hybrid type club.

[Club Length]

The club length is measured based on "1c Length" in "1 Clubs" of "Appendix II Design of Clubs" in the Golf Rules defined by R&A (Royal and Ancient Golf club of Saint Andrews). The club length is measured in a state where a club is placed on a horizontal plane and a sole is set against a plane of which an angle with respect to the horizontal plane is 60 degrees. The method for measuring the club length is referred to as a 60-degrees method.

The crown c1 includes a recess part RE1. The recess part RE1 forms a groove. As shown in FIG. 2, the recess part RE1 includes a toe-heel extension part RE11 extending in the toe-heel direction, a slope part RE12 slopingly extending to be positioned on a further back side as going to the toe side, and a slope part RE13 slopingly extending to be positioned on a further back side as going to the heel side. The slope part RE12 is connected to the toe side of the toe-heel extension part RE11. The slope part RE13 is connected to the heel side of the toe-heel extension part RE11.

The slope part RE12 has a slope angle θ12 exceeding the permissible range)(±20°) of the toe-heel direction. In FIG. 2 as an example, θ12 is 45°. The slope part RE13 has a slope angle θ13 exceeding the permissible range (±20°) of the toe-heel direction. In FIG. 2 as an example, θ13 is 45°. The angle θ12 and the angle θ13 are, for example, preferably equal to or greater than 20° and more preferably equal to or greater than 25°. The angle θ12 and the angle θ13 are, for example, preferably equal to or less than 65° and more preferably equal to or less than 60°. The angles θ12 and θ13 are angles with respect to the toe-heel reference direction. These angles are measured on the planar view.

The recess part RE1 divides the crown c1. The crown c1 includes a back part 100 positioned at the back of the recess part RE1, and a front part 102 positioned at the front of the recess part RE1.

FIG. 6 shows a cross-sectional view taken along line F2-F2 in FIG. 2. As mentioned above, the inside of the head h1 is hollow. FIG. 6 shows a cross section of only the crown c1.

As shown in FIG. 6, the recess part RE1 includes a first side surface 104 positioned on the face side, and a second side surface 106 positioned on the back side. The recess part RE1 further includes a bottom surface 108. The bottom surface 108 may not be present.

A virtual extension line HL1 is shown by a two-dot chain line in FIG. 6. The virtual extension line HL1 is an extension line of the back part 100. The virtual extension line HL1 is determined at each cross section taken along the front-back direction.

The virtual extension line HL1 is defined as follows. In a contour line of the surface of crown on a cross section taken along the front-back direction, a vertex of an angle on the back side of the recess part RE1 is defined as point Pa, a point separated by 0.5 mm backward from the point Pa is defined as point P1, a point separated by 0.5 mm backward from the point P1 is defined as point P2, and a point separated by 0.5 mm backward from the point P2 is defined as point P3 (See FIG. 6). The virtual extension line HL1 is a circle passing through the point P1, the point P2 and the point P3. When the point P1, the point P2 and the point P3 are on a straight line, the virtual extension line HL1 is a straight line passing through the point P1, the point P2 and the point P3. The above mentioned "0.5 mm" is measured along the front-back reference direction.

When the recess part RE1 is not present, the point Pa is set to a front end of the back part 100. In this case, the point Pa is on a lower end of a step surface ST1. When the recess part RE1 and the step surface ST1 are separated, the point Pa is on the lower end of the step surface ST1.

When the point Pa is unclear due to roundness, the point Pa is set to a middle point in a portion having the smallest curvature radius.

In the present application, a virtual extension surface HF1 is defined based on the virtual extension line HL1. The virtual extension surface HF1 is a surface formed by a set of the virtual extension lines HL1.

As shown in FIG. 6, the crown c1 includes the step surface ST1. The step surface ST1 is positioned at a front of the back part 100. The step surface ST1 is positioned above the virtual extension line HL1 (virtual extension surface HF1).

As shown in FIG. 6, the step surface ST1 is continuous with the first side surface 104. The step surface ST1 and the first side surface 104 form a continuous surface SR1. A boundary between the first side surface 104 and the step surface ST1 is the virtual extension surface HF1.

The first side surface 104 forms the continuous surface SR1 at all positions in the toe-heel direction. The step surface ST1 is provided along the whole recess part RE1. The continuous surface SR1 is provided along the whole recess part RE1.

A surface (outer surface) of the front part 102 connects an upper end of the step surface ST1 (continuous surface SR1) and an upper end of the face f1. The surface of the front part 102 forms a smooth curved surface extending between the upper end of the step surface ST1 and the upper end of the face surface f1.

A surface (outer surface) of the back part 100 connects an upper end of the second side surface 106 and a back end of the crown c1. The surface of the back part 100 forms a smooth curved surface extending between the upper end of the second side surface 106 and the back end of the crown c1.

In the present embodiment, the step surface ST1 extends along the recess part RE1. As a result, the continuous surface SR1 extends along the whole recess part RE1. As shown in FIG. 2, a part (middle part) of the recess part RE1 extends in the toe-heel direction, and a part of the step surface ST1 also extends in the toe-heel direction.

The recess part RE1 may be separated from the step surface ST1, although it is different from the present embodiment. The step surface ST1 may be provided at a front of the recess part RE1.

In the head h1, deformation of the crown c1 in hitting is promoted by the recess part RE1 (effect of promoting deformation). The deformation increases a loft angle. Thus, a launch angle is increased, and backspin is increased. In addition, rebound performance is improved because of the promotion of deformation.

Hereinafter, hitting at a hitting point of an upper side of the face f1 is also referred to as an "upper-side hitting". In the upper-side hitting, backspin is likely to be decreased due to a longitudinal gear effect. In this case, it becomes difficult to stop the ball near a target (pin). In a shot of aiming at a target, an increased backspin is desired. In the upper-side hitting, a great force acts on the crown c1. Therefore, the above mentioned effect of promoting deformation is particularly effective in the upper-side hitting. The recess part RE1 effectively restrains backspin from decreasing in the upper-side hitting.

The step surface ST1 is a surface opened backward. There is no backup at the back of the step surface ST1. Therefore, in hitting, the step surface ST1 can be deformed so as to fall backward. This deformation (falling deformation) can enhance the effect of promoting deformation (step-surface effect).

The virtual extension surface HF1 may intersect the surface of the face f1. When hitting is performed at a point above the intersection line, the falling deformation is likely to occur. Therefore, the step-surface effect is further enhanced.

The back part 100 is disposed on a lower side than the front part 102 because of the presence of the step surface ST1. The low back part 100 can lower a center of gravity of the head. Although the presence of the recess part RE1 can cause a disadvantage of making the center of gravity of the head higher, the low back part 100 can offset the disadvantage (offset effect). The low center of gravity contributes to a high launch angle, and facilitates a shot of aiming at a target.

The recess part RE1 is visually recognized by the golf player at address. The recess part RE1 extending in the toe-heel direction is almost parallel to the face surface. The recess part RE1 can facilitate aiming the face surface toward a target. In other words, the recess part RE1 can improve an alignment characteristic (alignment effect). The step surface ST1 extending along the recess part RE1 can further enhance the alignment characteristic.

In the embodiment of FIG. 6, the continuous surface SR1 is formed. The continuous surface SR1 is taller than the step surface ST1, and thereby being likely to be deformed in hitting. Not only the step surface ST1 but also the whole continuous surface SR1 can be deformed to fall backward (effect of increasing the falling deformation). For this reason, the step-surface effect is further enhanced. The continuous surface SR1 enhances a synergistic effect of the recess-part effect and the step-surface effect.

A heel-divisional plane PL1 is shown by a two-dot chain line in FIG. 3. The plane PL1 is parallel to the axial line of the shaft. The plane PL1 is brought into contact with an outer peripheral surface of the hosel z1. In the reference state, an intersection line of the plane PL1 and the horizontal plane H is parallel to the front-back reference direction.

Of the crown c1, a portion at a back of the hosel z1 is less likely to be deformed because of the presence of the hosel z1. In the head h1, the heel end of the recess part RE1 is positioned on the heel side with respect to the heel-divisional plane PL1. The heel end of the step surface ST1 is positioned on the heel side with respect to the heel-divisional plane PL1. Therefore, the heel side of the crown c1 is likely to be deformed despite the presence of the hosel z1.

As shown in FIG. 2, the recess part RE1 cuts across the crown c1. As shown in FIG. 4, an end Et on the toe side of the recess part RE1 divides a contour line Lc of the crown c1. The end Et is positioned on the side part d1. As shown in FIG. 5, an end Eh on the heel side of the recess part RE1 divides the contour line Lc of the crown c1. The end Eh is positioned on the side part d1.

As shown in FIG. 2, the recess part RE1 continuously extends from the first end Et to the second end Eh thereof. The first end Et divides the contour line Lc at a first position, and the second end Eh divides the contour line Lc at a second position. The recess part RE1 divides the surface of the crown c1. In the crown c1, the recess-part effect can spread to the whole face f1. For this reason, deformation of the crown c1 can be further facilitated. The recess-part effect is enhanced by the recess part RE1.

The recess part RE1 has a length longer than a face length. Therefore, the recess-part effect is enhanced. The length of the recess part RE1 can be considered as a length of a line formed by a set of the points Pa. This length is a three-dimensional length. The face length is a maximum width of the face surface in the toe-heel reference direction.

When an extending direction of the recess part RE1 is unclear, the extending direction of the line formed by a set of the points Pa is regarded as the extending direction of the recess part RE1. When an extending direction of the step surface ST1 is unclear, an extending direction of the upper end of the step surface ST1 is regarded as the extending direction of the step surface ST1.

An end on the toe side of the step surface ST1 is positioned on the side part d1. An end on the heel side of the step surface ST1 is positioned on the side part d1. The step surface ST1 cuts across the crown c1. The step-surface effect can be improved by the step surface ST1.

An end on the toe side of the continuous surface SR1 is positioned on the side part d1. An end on the heel side of the continuous surface SR1 is positioned on the side part d1. The continuous surface SR1 cuts across the crown c1. The synergistic effect of the recess part RE1 and the step surface ST1 is further enhanced by the continuous surface SR1.

A distance between the upper end of the face f1 and the step surface ST1 is shown by a double-pointed arrow T in FIG. 2. The distance T is measured along the front-back reference direction. The distance T is determined at each position in the toe-heel reference direction.

The shorter the distance T is, the nearer a distance between the step surface ST1 and the hitting face is. It is considered that stress acting on a position becomes greater, as the position approaches the hitting face. Therefore, it is considered that as the distance T becomes shorter, the effect of promoting deformation becomes greater. The inventors of the present application, however, have found that there is an optimum value for the distance T. As shown in Examples below (Table 6), when T is equal to or greater than 5 mm, the effect of promoting deformation is great. The distance T is preferably equal to or greater than 5 mm, more preferably equal to or greater than 7 mm, and still more preferably equal to or greater than 9 mm. In light of the effect of promoting deformation, the distance T is equal to or less than 25 mm, and more preferably equal to or less than 20 mm.

As shown in FIG. 6, the first side surface 104 is inclined to be forward as going upward. The second side surface 106 is inclined to be backward as going upward. The step surface ST1 is inclined to be forward as going upward. The inclination direction of the first side surface 104 is the same as the inclination direction of the step surface ST1. An interval between the first side surface 104 and the second side surface 106 becomes wider as going to the upper side. Therefore, a draft angle is secured. For this reason, the crown c1 is easily formed.

Figure 7:
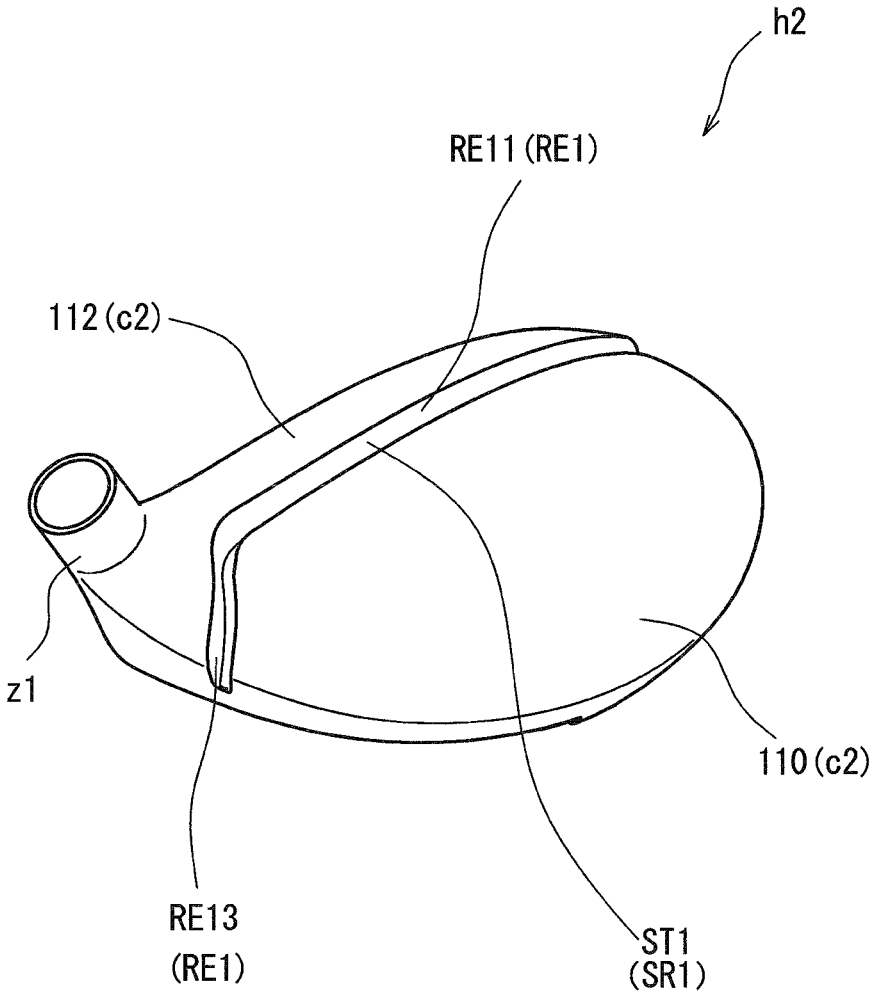
FIG. 7 shows a perspective view of a head according to a second embodiment.
Figure 8:
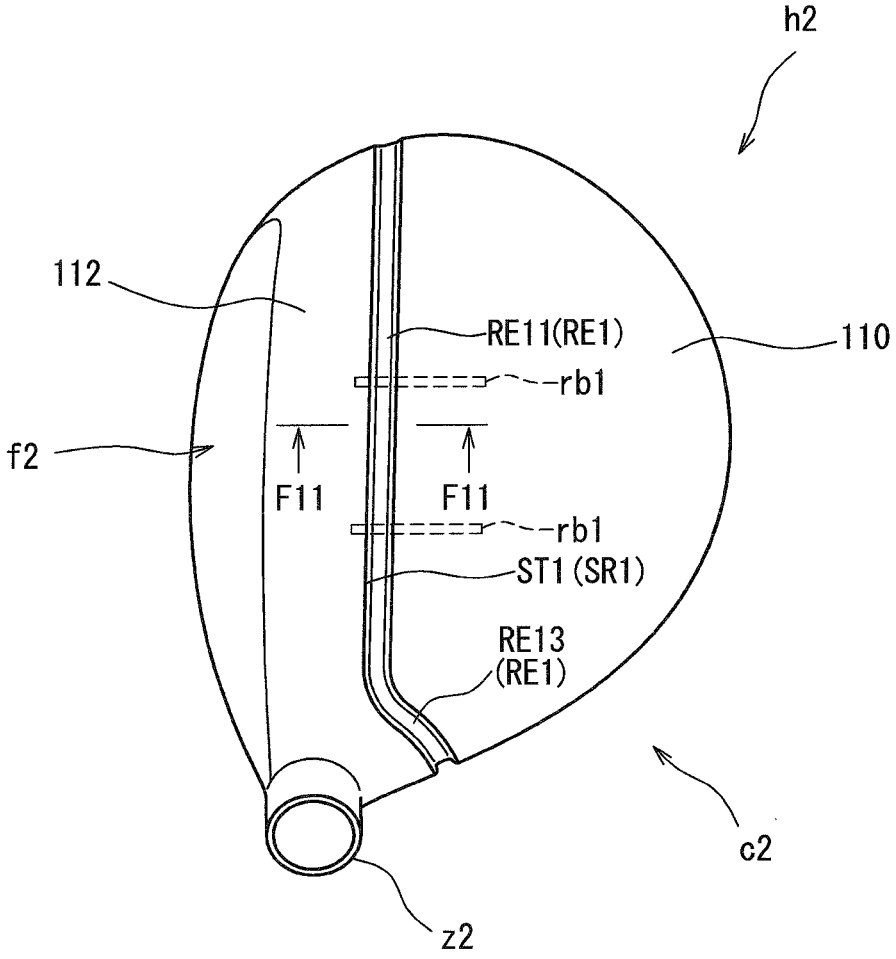
FIG. 8 shows a plan view of the head in FIG. 7.
Figure 9:
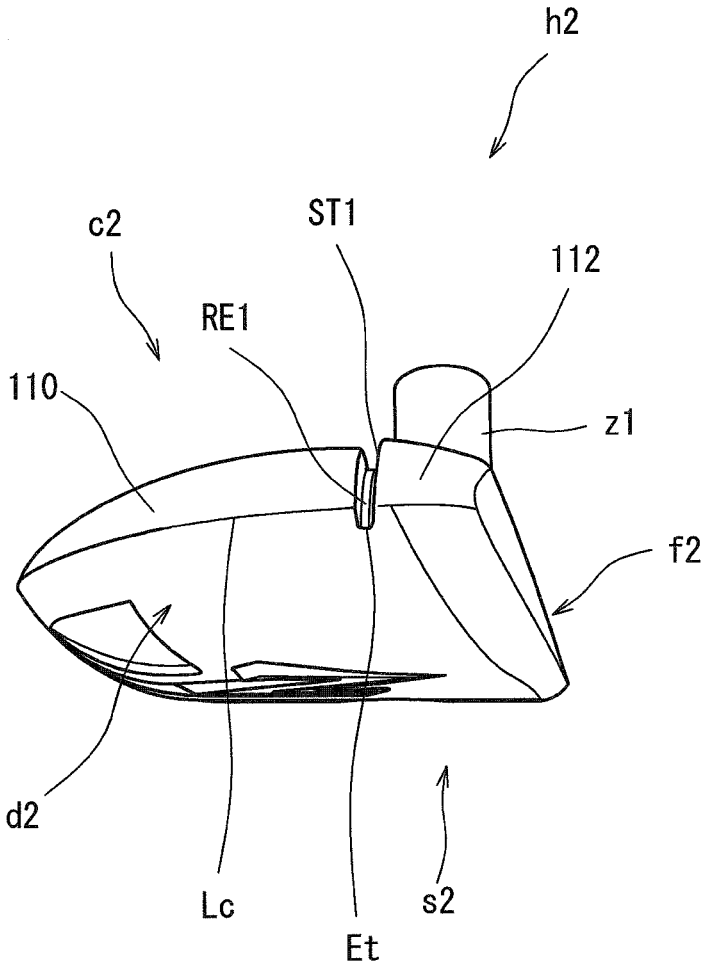
FIG. 9 shows a toe-side view of the head in FIG. 7.
Figure 10:
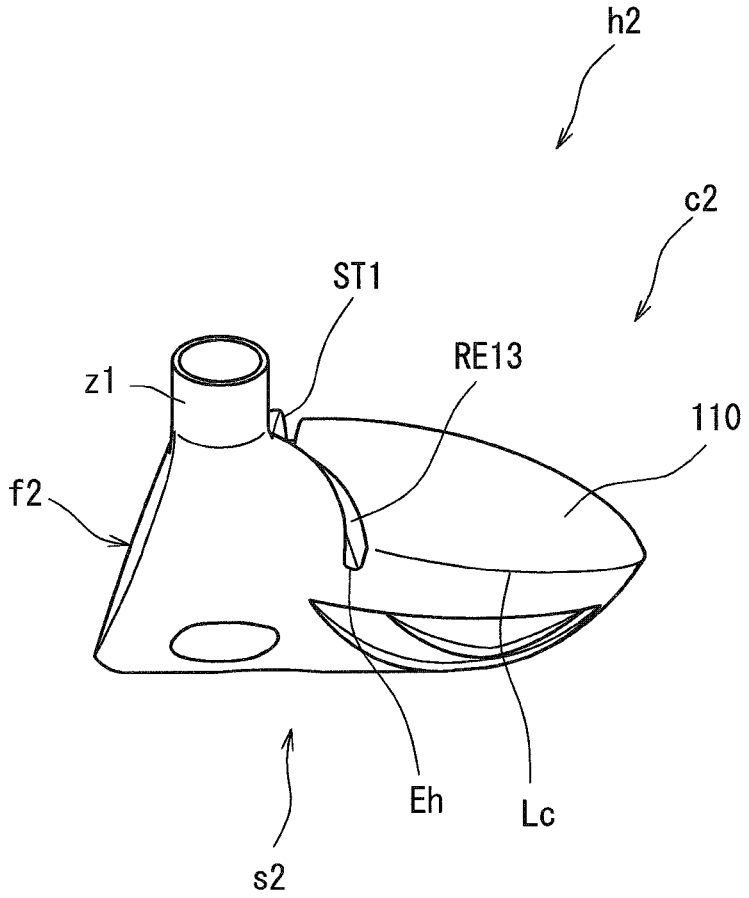
FIG. 10 shows a heel-side view of the head in FIG. 7.
Figure 11:
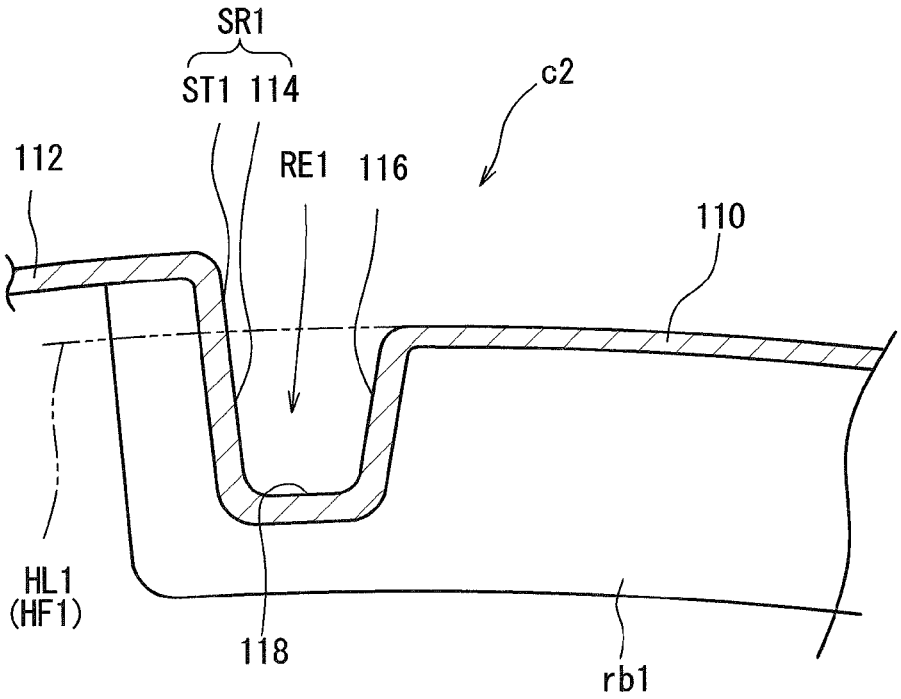
FIG. 11(*a*) shows a cross-sectional view taken along line F11-F11 in FIG. 8, FIG. 11(*a*) is a partial cross-sectional view of a crown, and FIG. 11(*b*) shows a cross-sectional view showing a modified embodiment of FIG. 11(*a*)
Figure 11:
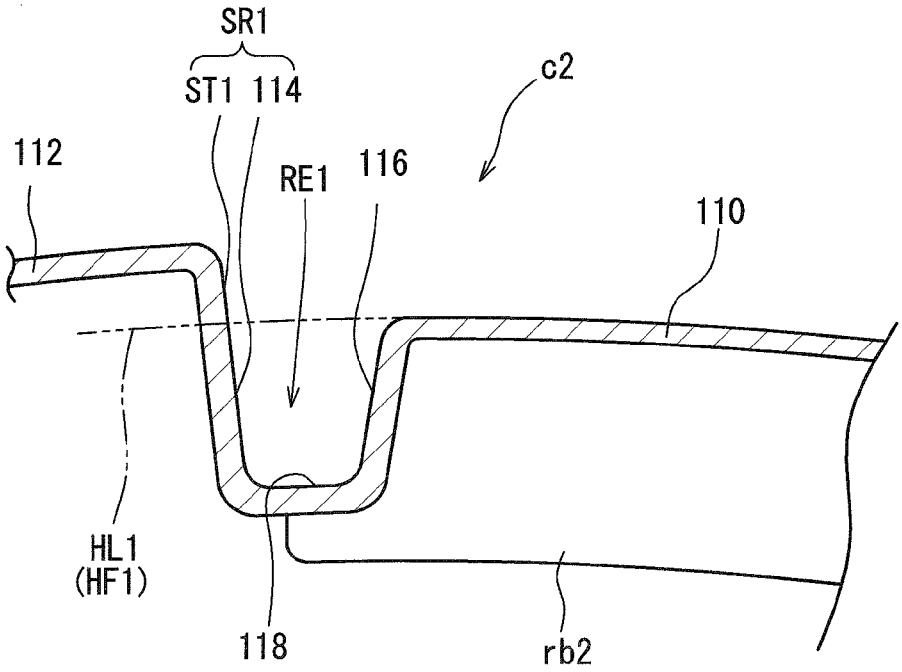

FIG. 7 shows a perspective view of a head h2. FIG. 8 shows a plan view of the head h2. FIG. 8 is a figure viewed from the crown side. FIG. 9 shows a side view of the toe side of the head h2. FIG. 10 shows a side view of the heel side of the head h2. FIG. 11(*a*) shows a cross-sectional view taken along line F11-F11 in FIG. 8.

The head h2 is a wood type head. The head h2 is a so-called fairway wood type. The inside of the head h2 is hollow. In other words, the head h2 has a hollow structure.

The head h2 includes a crown c2, a sole s2, a hosel z2 and a face f2. The crown c2 extends toward the back side from an upper edge of the face f2. The sole s2 extends toward the back side from a lower edge of the face f2. An outer surface of the face f2 is a hitting face. The hitting face is also referred to as a face surface.

The head h2 further includes a side part d2. The side part d2 extends between the crown c2 and the sole s2. The side part d2 is also referred to as a skirt.

The crown c2 includes a recess part RE1. The recess part RE1 forms a groove. As shown in FIG. 8, the recess part RE1 includes a toe-heel extension part RE11 extending in the toe-heel direction, and a slope part RE13 slopingly extending to be positioned on a further back side as going to the heel side. The slope part RE13 is connected to the heel side of the toe-heel extension part RE11.

The recess part RE1 divides the crown c1. The crown c1 includes a back part 110 positioned at a back of the recess part RE1, and a front part 112 positioned at a front of the recess part RE1.

FIG. 11(*a*) shows a cross-sectional view taken along line F11-F11 in FIG. 8. The inside of the head h2 is hollow, and FIG. 11(*a*) shows a cross section of only the crown c2.

As shown in FIG. 11(*a*), the recess part RE1 includes a first side surface 114 positioned on the face side and a second side surface 116 positioned on the back side. The recess part RE1 further includes a bottom surface 118.

As shown in FIG. 11(*a*), the crown c2 includes a step surface ST1. The step surface ST1 is positioned at a front of the back part 110. The step surface ST1 is positioned above a virtual extension line HL1 (virtual extension surface HF1).

As shown in FIG. 11(*a*), the step surface ST1 is continuous with the first side surface 114. The step surface ST1 and the first side surface 114 form a continuous surface SR1. A boundary between the first side surface 114 and the step surface ST1 is the virtual extension surface HF1.

A surface (outer surface) of the front part 112 connects an upper end of the step surface ST1 (continuous surface SR1) and an upper end of the face f2. The surface of the front part 112 forms a smooth curved surface extending between the upper end of the step surface ST1 and the upper end of the face f2.

A surface (outer surface) of the back part 110 connects an upper end of the second side surface 116 and a back end of the crown c2. The surface of the back part 110 forms a smooth curved surface extending between the upper end of the second side surface 116 and the back end of the crown c2.

In the present embodiment, the continuous surface SR1 is formed. The step surface ST1 extends along the recess part RE1. As shown in FIG. 8, a part (other than the heel portion) of the recess part RE1 extends in the toe-heel direction, and a part of the step surface ST1 also extends in the toe-heel direction.

Also in the head h2, the recess-part effect, the step-surface effect, and the synergistic effect are exhibited.

Also in the embodiment of FIG. 11(*a*), the continuous surface SR1 is formed. As mentioned above, not only the step surface ST1 but also the whole continuous surface SR1 can be deformed to fall backward. For this reason, the step-surface effect is further enhanced. The continuous surface SR1 enhances the synergistic effect of the recess-part effect and the step-surface effect.

As shown in FIG. 8, the recess part RE1 cuts across the crown c2. As shown in FIG. 9, an end Et on the toe side of the recess part RE1 divides a contour line Lc of the crown c2. The end Et is positioned on the side part d2. As shown in FIG. 10, an end Eh on the heel side of the recess part RE1 divides the contour line to of the crown c1. The end Eh is positioned on the side part d2.

The recess part RE1 having such a structure further facilitates deformation of the crown c2. The recess part RE1 enhances the recess-part effect.

As mentioned above, the recess part RE1 and the step surface ST1 is unitary. An end on the toe side of the step surface ST1 is positioned on the side part d2. An end on the heel side of the step surface ST1 is positioned on the side part d2. The step surface ST1 cuts across the crown c2. The step-surface effect can be improved by the step surface ST1.

An end on the toe side of the continuous surface SR1 is positioned on the side part d2. An end on the heel side of the continuous surface SR1 is positioned on the side part d2. The continuous surface SR1 cuts across the crown c2. The synergistic effect is further enhanced by the continuous surface SR1.

As shown in FIG. 8, the head h2 includes a rib rb1. The rib rb1 is provided on an inner surface of the crown c2. The number of the ribs rb1 may be one or plural. In the head h2, a plurality of (two) ribs rb1 are provided.

The rib rb1 is connected to the recess part RE1. The rib rb1 intersects the recess part RE1 (See FIG. 8 and FIG. 11(*a*)). A front end of the rib rb1 is positioned at a front of the recess part RE1. A back end of the rib rb1 is positioned at a back of the recess part RE1.

FIG. 11(*b*) shows a modified embodiment of a rib rb2. The rib rb2 is connected to the recess part RE1. The rib rb2 extends backward from a middle position in the width direction of the recess part RE1.

As mentioned above, the ribs rb1 and rb2 are connected to the recess part RE1. The ribs rb1 and rb2 can suppress the effect of promoting deformation because of the recess part RE1. The effect of promoting deformation can be controlled by disposal and rigidity of the rib. For example, the rib may be provided on only a middle region Rc in the toe-heel direction. This structure is effective in a case, for example, where a coefficient of restitution (COR) at the face center fc is excessively great. The rib can locally suppress deformation of the crown c2.

Figure 12:
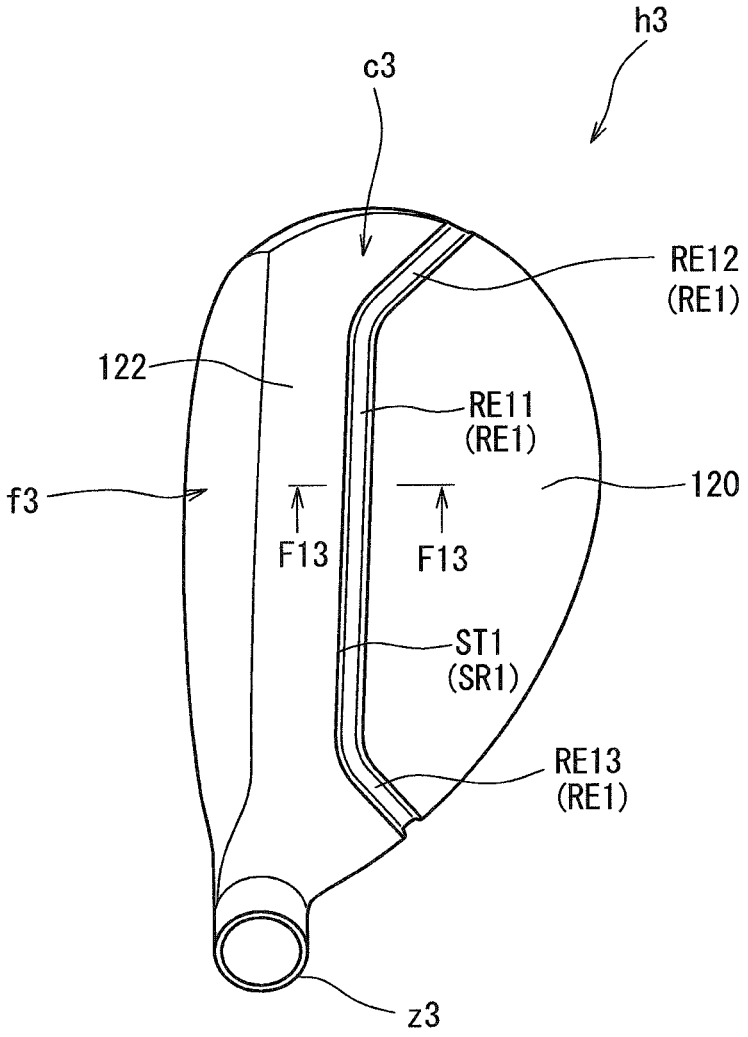
FIG. 12 shows a plan view of a head according to a third embodiment.
Figure 13:
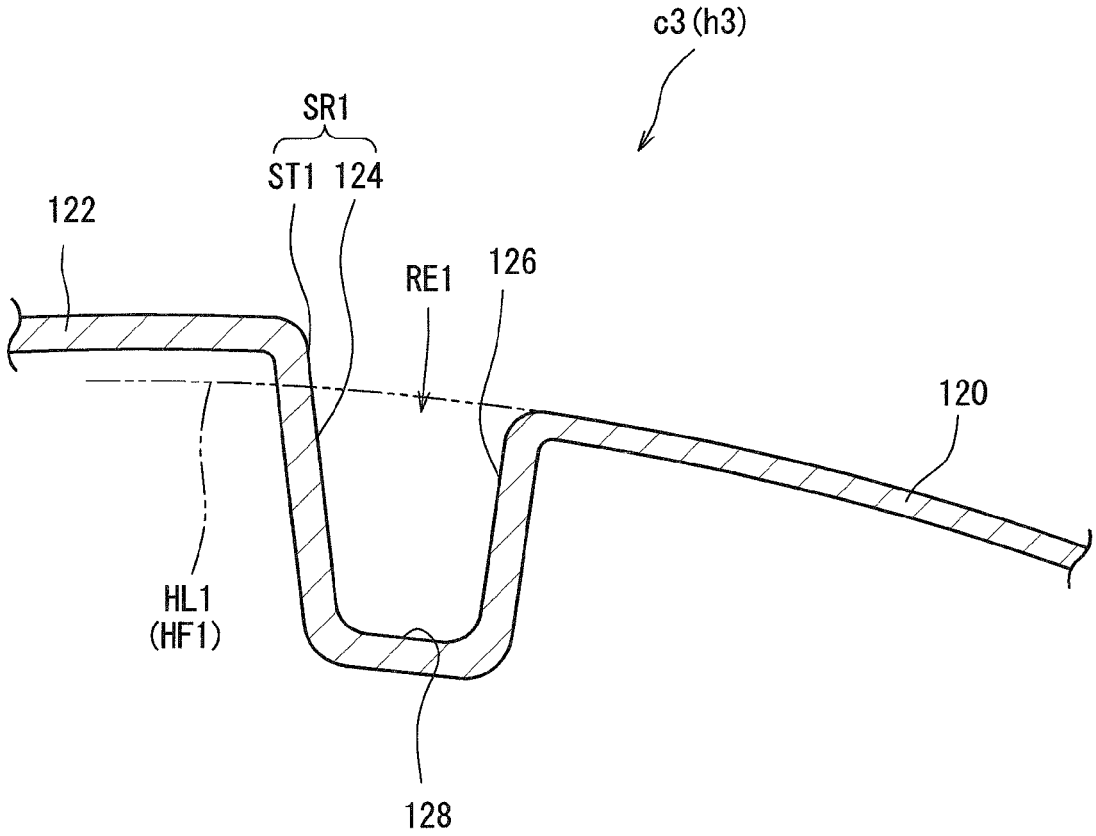
FIG. 13 shows a cross-sectional view taken along line F13-F13 in FIG. 12.

FIG. 12 shows a plan view of a head h3. FIG. 13 is a cross-sectional view taken along line F13-F13 in FIG. 12.

The head h3 is a wood type head. The head h3 is a so-called hybrid type. The inside of the head h3 is hollow. In other words, the head h3 has a hollow structure.

The head h3 includes a crown c3, a sole (not shown in the drawings), a hosel z3 and a face f3. The crown c3 extends toward the back side from an upper edge of the face f3. The sole extends toward the back side from a lower edge of the face f3. An outer surface of the face f3 is a hitting face. The head h3 further includes a side part (not shown in the drawings). The side part extends between the crown c3 and the sole.

The crown c3 includes a recess part RE1. The recess part RE1 forms a groove. As shown in FIG. 12, the recess part RE1 includes a toe-heel extension part RE11 extending in the toe-heel direction, a slope part RE12 slopingly extending to be positioned on a further back side as going to the toe side, and a slope part RE13 slopingly extending to be positioned on a further back side as going to the heel side. The slope part RE12 is connected to the toe side of the toe-heel extension part RE11. The slope part RE13 is connected to the heel side of the toe-heel extension part RE11.

The recess part RE1 divides the crown c3. The crown c3 includes a back part 120 positioned at a back of the recess part RE1, and a front part 122 positioned at a front of the recess part RE1.

FIG. 13 is a cross-sectional view taken along line F13-F13 in FIG. 12. The inside of the head h3 is hollow, and FIG. 13 shows a cross section of only the crown c3.

As shown in FIG. 13, the recess part RE1 includes a first side surface 124 positioned on the face side, and a second side surface 126 positioned on the back side. The recess part RE1 further includes a bottom surface 128.

As shown in FIG. 13, the crown c3 includes a step surface ST1. The step surface ST1 is positioned at a front of the back part 120. The step surface ST1 is positioned above the virtual extension line HL1 (virtual extension surface HF1).

As shown in FIG. 13, the step surface ST1 is continuous with the first side surface 124. The step surface ST1 and the first side surface 124 form the continuous surface SR1. A boundary between the first side surface 124 and the step surface ST1 is the virtual extension surface HF1.

Also in the head h3, the recess-part effect, the step-surface effect, and the offset effect are exhibited. In addition, the synergistic effect of the recess-part effect and the step-surface effect is enhanced because of the continuous surface SR1.

Figure 14:
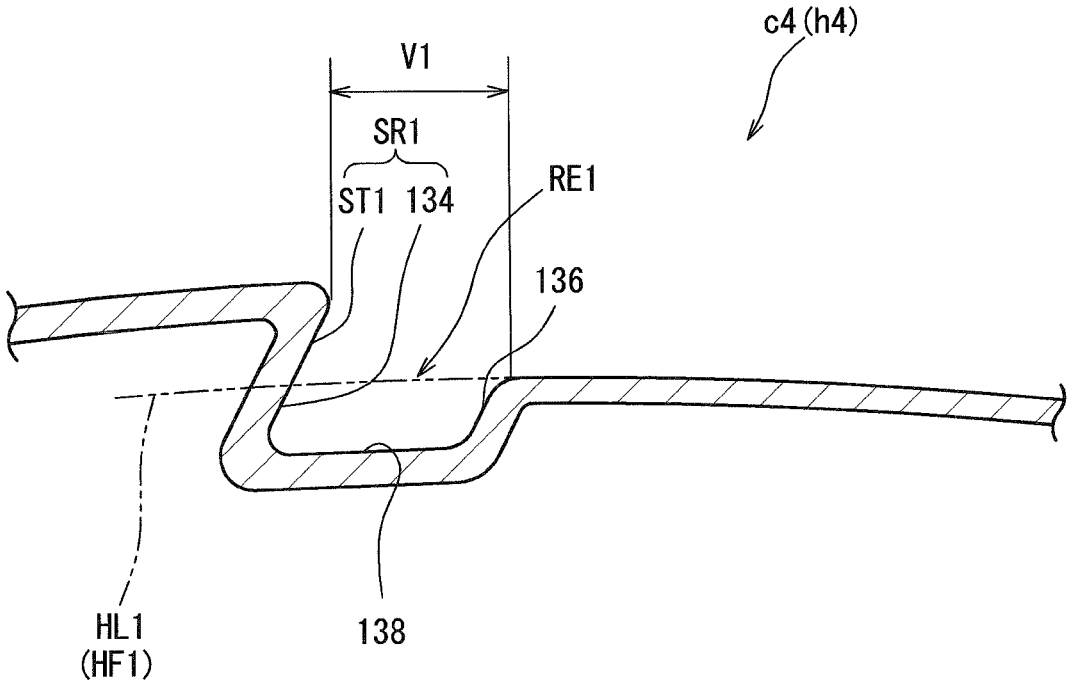
FIG. 14 shows a cross-sectional view of a head according to a fourth embodiment.

FIG. 14 shows a cross-sectional view of a crown c4 of a head h4 according to a modified embodiment. The crown c4 includes a recess part RE1 and a step surface ST1. The recess part RE1 includes a first side surface 134, a second side surface 136, and a bottom surface 138. The step surface ST1 is continuous with the first side surface 134 so as to form a continuous surface SR1.

As shown in FIG. 14, the first side surface 134 is inclined to be further backward as going upward. The second side surface 136 is inclined to be further backward as going upward. The step surface ST1 is inclined to be further backward as going upward. An inclination direction of the first side surface 134 is the same as an inclination direction of the step surface ST1. The inclination direction of the first side surface 134 is the same as an inclination direction of the second side surface 136. An interval between the first side surface 134 and the second side surface 136 is constant regardless of the position in the up-down direction. Therefore, it is possible to extract a mold.

An apparent width of the recess part RE1 is shown by a double-pointed arrow V1 in FIG. 14. The width V1 shows a width of the recess part RE1 which is visually recognized at address. Since the first side surface 134 is inclined backward, a part of the recess part RE1 is hidden by the first side surface 134. In addition, since the step surface ST1 is inclined backward, a part of the recess part RE1 is hidden by the step surface ST1. As a result, the apparent width V1 is made small. The apparent width V1 is suppressed while the volume of the recess part RE1 is secured. Because of the small apparent width V1, the recess part RE1 becomes inconspicuous.

As mentioned above, the recess part RE1 can produce the alignment effect. However, some golf players can have an uncomfortable feeling because of the visual recognition of the recess part RE1. The uncomfortable feeling can also be caused by the extending direction of the recess part RE1 and the like. The uncomfortable feeling due to the recess part RE1 can be suppressed by making the recess part RE1 inconspicuous.

Since the first side surface 134 is inclined backward, the first side surface 134 is likely to fall backward. Therefore, the falling deformation can be easily produced. In addition, since the continuous surface SR1 including the step surface ST1 is inclined backward, the effect of increasing the falling deformation is enhanced. Because of these facts, deformation of the crown c4 is further promoted.

Figure 15:
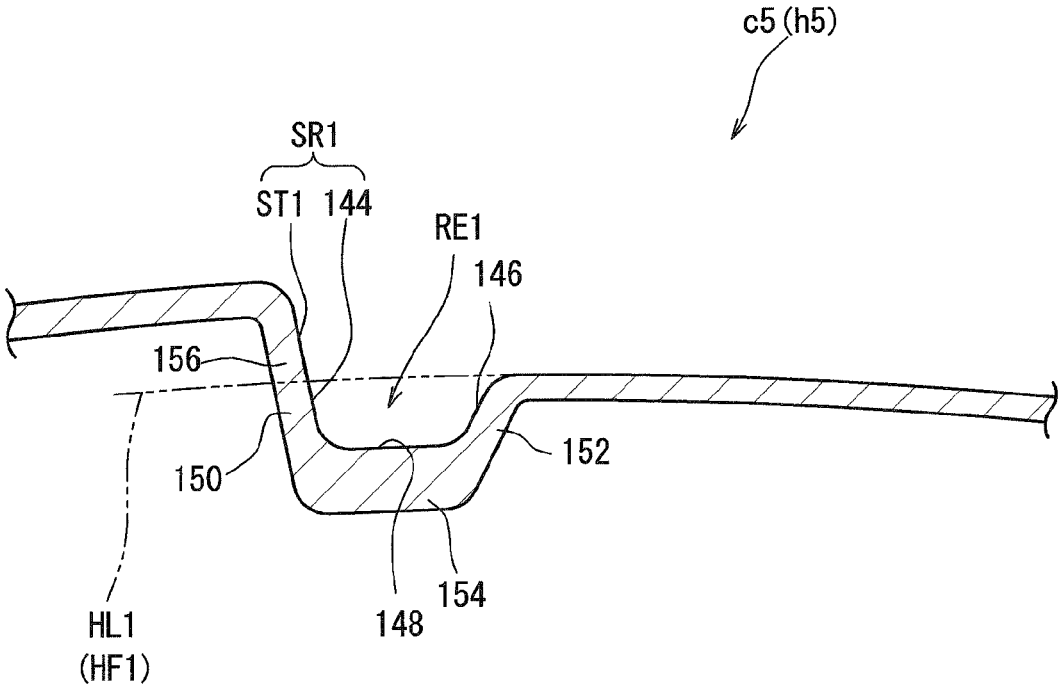
FIG. 15 shows a cross-sectional view of a head according to a fifth embodiment.

FIG. 15 shows a cross-sectional view of a crown c5 of a head h5 according to another modified embodiment. The crown c5 includes a recess part RE1 and a step surface ST1. The recess part RE1 includes a first side surface 144, a second side surface 146, and a bottom surface 148. The step surface ST1 is continuous with the first side surface 144 so as to form a continuous surface SR1.

The recess part RE1 includes a first side part 150, a second side part 152 and a bottom part 154. The first side part 150 is a portion having the first side surface 144 as a surface thereof. The second side part 152 is a portion having the second side surface 146 as a surface thereof. The bottom part 154 is a portion having the bottom surface 148 as a surface thereof. The step part 156 is a portion having the step surface ST1 as a surface thereof.

The bottom part 154 has a thickness greater than a thickness of the first side part 150. The thickness of the bottom part 154 is greater than a thickness of the second side part 152. The thickness of the bottom part 154 is greater than a thickness of the step part 156. By thickening only the bottom part 154, durability can be improved while reduction of the effect of promoting deformation is suppressed. Thus, the bottom part 154 preferably has the maximum thickness in the recess part RE1.

It is preferable that a thickness of at least a part of the recess part RE1 is greater than a minimum thickness of the crown. In this case, durability of the recess part RE1 can be improved while a weight of the crown is suppressed.

Figure 16:
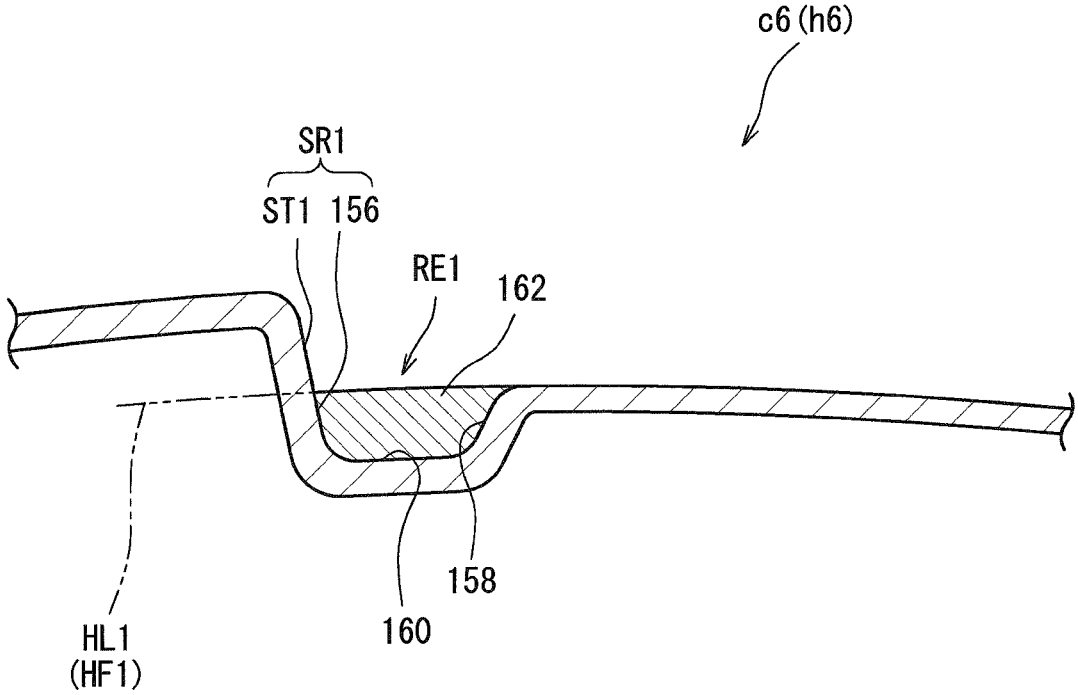
FIG. 16 shows a cross-sectional view of a head according to a sixth embodiment.

FIG. 16 shows a cross-sectional view of a crown c6 of a head h6 according to another modified embodiment. The crown c6 includes a recess part RE1 and a step surface ST1. The recess part RE1 includes a first side surface 156, a second side surface 158, and a bottom surface 160. The step surface ST1 is continuous with the first side surface 156 so as to form a continuous surface SR1.

The crown c6 includes a filler 162. The filler 162 is disposed inside the recess part RE1. The filler 162 occupies at least a part of the recess part RE1. In the present embodiment, the filler 162 occupies the whole recess part RE1. The filler 162 covers the whole first side surface 156. The filler 162 covers the whole second side surface 158. The filler 162 covers the whole bottom surface 160. An upper surface of the filler 162 is substantially equivalent to the virtual extension surface HF1. The substantially equivalent means that a difference in the up-down direction is equal to or less than 0.2 mm.

The filler 162 make the recess part RE1 inconspicuous. Therefore, the uncomfortable feeling at address due to the recess part RE1 can be suppressed.

By appropriately selecting a material for the filler 162, the filler 162 does not hamper deformation of the recess part RE1. In addition, the filler 162 can produce a vibration absorbing effect. The vibration absorbing effect can enhance durability of the recess part RE1.

In light of not hampering deformation of the crown, and in light of vibration absorption, the material of the filler 162 is preferably a polymer. Examples of the polymer include an elastomer (including a rubber) and a resin.

More specifically, examples of the polymer include a thermosetting polymer and a thermoplastic polymer. Examples of the thermosetting polymer include a phenol resin, an epoxy resin, a melamine resin, a urea resin, an unsaturated polyester resin, an alkyd resin, a thermosetting polyurethane, a thermosetting polyimide, and a thermosetting elastomer. Examples of the thermoplastic polymer include polyethylene, polypropylene, polyvinyl chloride, polystyrene, polytetrafluoroethylene, an ABS resin (acrylonitrile butadiene styrene resin), an acrylic resin, polyamide, polyacetal, polycarbonate, modified polyphenylene ether, polybutylene terephthalate, polyethylene terephthalate, polyphenylene sulfide, polyether ether ketone, a thermoplastic polyimide, polyamide imide, and a thermoplastic elastomer.

Examples of the thermoplastic elastomer include a thermoplastic polyamide elastomer, a thermoplastic polyester elastomer, a thermoplastic polystyrene elastomer, a thermoplastic polyester elastomer, and a thermoplastic polyurethane elastomer.

In light of durability, a urethane-based polymer and polyamide are preferable, and the urethane-based polymer is more preferable. Examples of the urethane-based polymer include polyurethane and a thermoplastic polyurethane elastomer. The urethane-based polymer may be thermoplastic, or may be thermosetting.

In light of formability, a thermoplastic polymer is preferable. In light of a hardness and durability, in the thermoplastic polymer, the polyamide and the thermoplastic polyurethane elastomer are preferable, and the thermoplastic polyurethane elastomer is more preferable.

Examples of the polyamide include nylon 6, nylon 11, nylon 12, and nylon 66.

A preferable thermoplastic polyurethane elastomer contains a polyurethane component as a hard segment, and a polyester component or a polyether component as a soft segment. That is, preferable examples of the thermoplastic polyurethane elastomer (TPU) include a polyester-based TPU and a polyether-based TPU. Examples of a curing agent for the polyurethane component include cycloaliphatic diisocyanate, aromatic diisocyanate, and aliphatic diisocyanate.

Commercially available examples of the thermoplastic polyurethane elastomer (TPU) include trade name "Elastollan" manufactured by BASF Japan Ltd.

Figure 17:
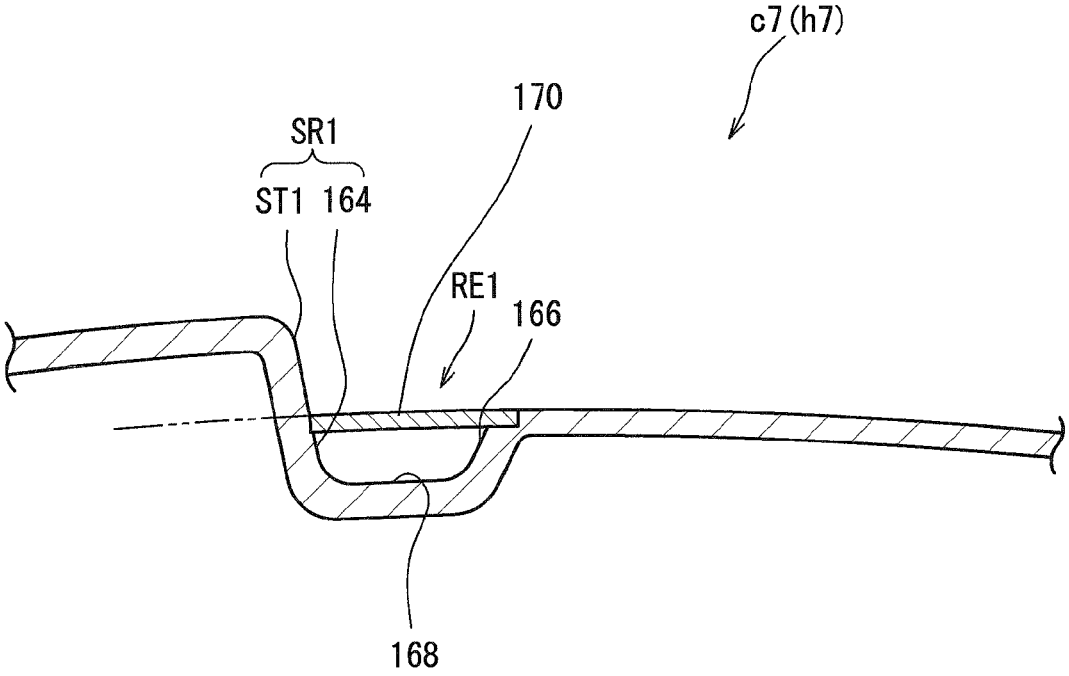
FIG. 17 shows a cross-sectional view of a head according to a seventh embodiment.

FIG. 17 shows a cross-sectional view of a crown c7 of a head h7 according to another modified embodiment. The crown c7 includes a recess part RE1 and a step surface ST1. The recess part RE1 includes a first side surface 164, a second side surface 166 and a bottom surface 168. The step surface ST1 is continuous with the first side surface 164 so as to form a continuous surface SR1.

The crown c7 includes a lid member 170. The lid member 170 covers an opening of the recess part RE1. The lid member 170 make the recess part RE1 inconspicuous. Therefore, the uncomfortable feeling at address due to the recess part RE1 can be suppressed.

Figure 18A:
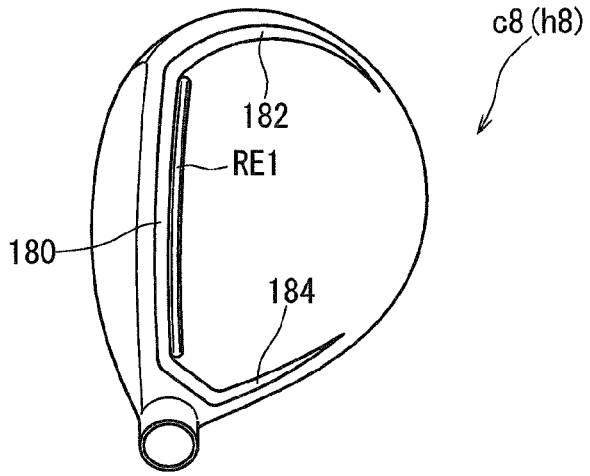
FIG. 18(*a*) shows a plan view of a head according to an eighth embodiment, FIG. 18(*b*) shows a plan view of a head according to a ninth embodiment, FIG. 18(*c*) shows a plan view of a head according to a tenth embodiment.
Figure 18B:
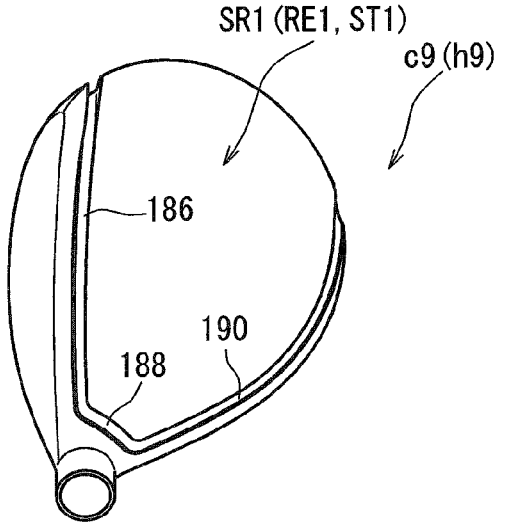
Figure 18C:
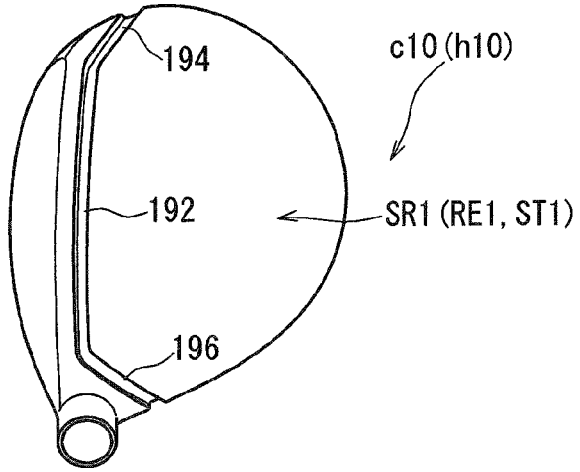
Figure 24A:
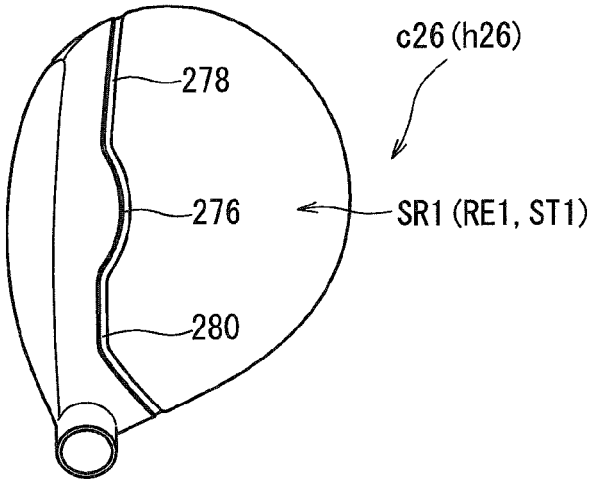
FIG. 24(*a*) shows a plan view of a head according to a twenty sixth embodiment, FIG. 24(*b*) shows a plan view of a head according to a twenty seventh embodiment, and FIG. 24(*c*) shows a plan view of a head according to a twenty eighth embodiment.
Figure 24B:
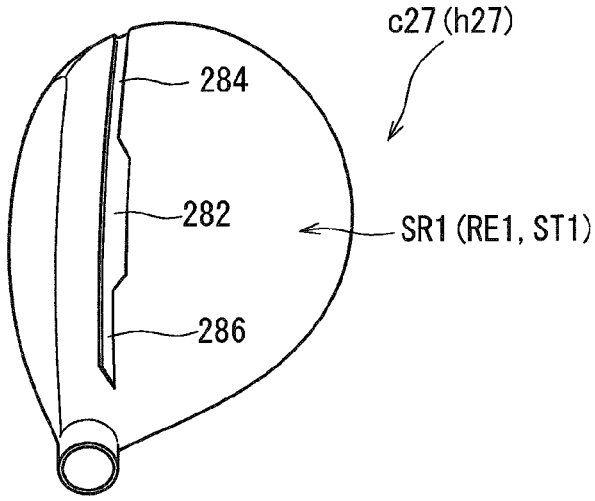
Figure 24C:
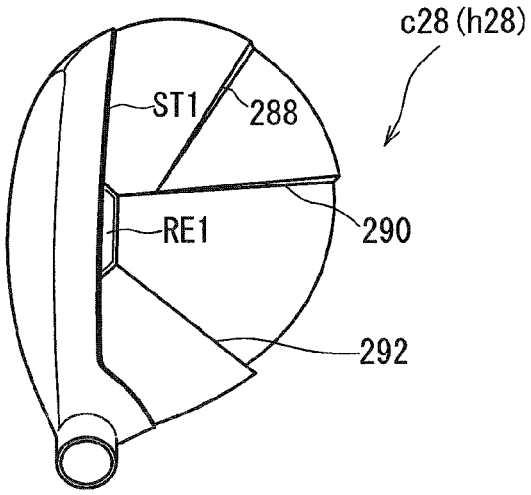

FIG. 18(*a*) to FIG. 24(*c*) show heads according to modified embodiments.

In a head h8 of FIG. 18(*a*), a crown c8 includes a step surface ST1 and a recess part RE1. The step surface ST1 is an inclined surface that is inclined with respect to the up-down direction. The step surface ST1 is clearly visible in the planar view (See FIG. 18(*a*)). The step surface ST1 includes a first portion 180, a second portion 182 connected to the toe end of the first portion 180 and extends backward, and a third portion 184 connected to the heel end of the first portion 180 and extends backward. The recess part RE1 is disposed on a back of the first portion 180. The recess part RE1 extends in the toe-heel direction.

An angle between the step surface ST1 and the up-down direction is preferably equal to or less than 60°, more preferably equal to or less than 45°, and still more preferably equal to or less than 30°.

In a head h9 of FIG. 18(*b*), a crown c9 includes a step surface ST1 and a recess part RE1. The recess part RE1 and the step surface ST1 form a continuous surface SR1. The continuous surface SR1 and the recess part RE1 include a first portion 186 that extends in the toe-heel direction, a second portion 188 connected to the heel end of the first portion 186, and a third portion 190 connected to the back end of the second portion 188. The toe end of the first portion 186 extends to reach a side part. The second portion 188 slopingly extends to be positioned on a further heel side as going backward. The third portion 190 extends toward the toe side from the back end of the second portion 188. The toe end of the third portion 190 extends to reach the side part.

In a head h10 of FIG. 18(*c*), a crown c10 includes a step surface ST1 and a recess part RE1. The recess part RE1 and the step surface ST1 form a continuous surface SR1. The continuous surface SR1 and the recess part RE1 include a first portion 192 that extends in the toe-heel direction, a second portion 194 connected to the toe end of the first portion 192, and a third portion 196 connected to the heel end of the first portion 192. The toe end of the second portion 194 extends to reach a side part. The second portion 194 slopingly extends to be positioned on a further toe side as going backward. The heel end of the third portion 196 extends to reach the side part. The third portion 196 slopingly extends to be positioned on a further heel side as going backward. The heel end of the third portion 196 is positioned on a back with respect to the toe end of the second portion 194.

Figure 19A:
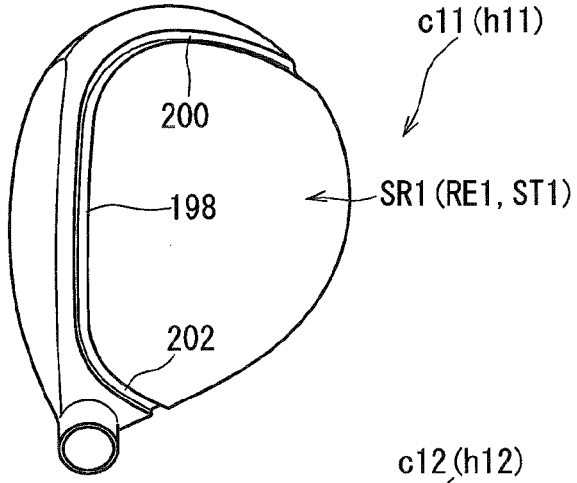
FIG. 19(*a*) shows a plan view of a head according to an eleventh embodiment, FIG. 19(*b*) shows a plan view of a head according to a twelfth embodiment, and FIG. 19(*c*) shows a plan view of a head according to a thirteenth embodiment.
Figure 19B:
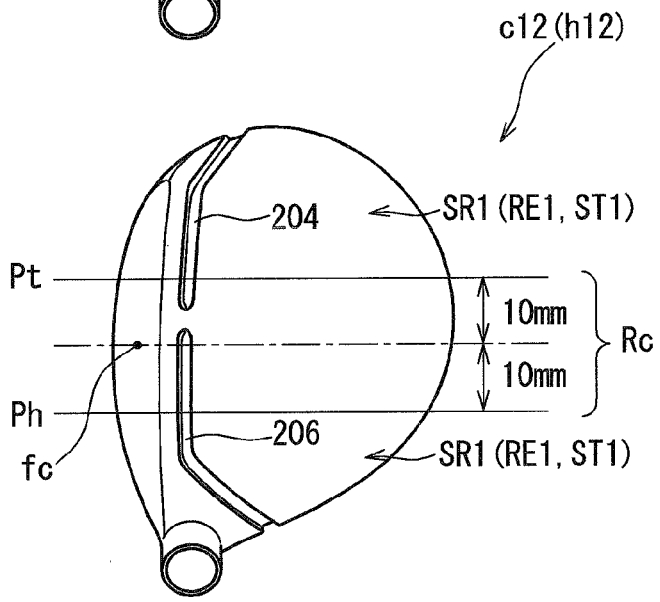
Figure 19C:
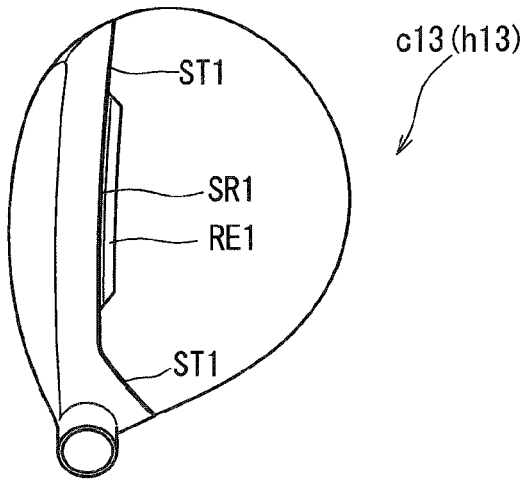

In a head h11 of FIG. 19(*a*), a crown c11 includes a step surface ST1 and a recess part RE1. The crown c11 includes the above described continuous surface SR1. The continuous surface SR1 and the recess part RE1 include a first portion 198 that extends in the toe-heel direction, a second portion 200 connected to the toe end of the first portion 198, and a third portion 202 connected to the heel end of the first portion 198. The second portion 200 includes a portion extending in the front-back direction. The back end of the second portion 200 extends to reach a side part. The heel end of the third portion 202 extends to reach the side part. The third portion 202 slopingly extends to be positioned on a further heel side as going backward. The back end of the second portion 200 is positioned on a back with respect to the back end of the third portion 202.

In a head h12 of FIG. 19(*b*), a crown c12 includes a step surface ST1 and a recess part RE1. The recess part RE1 and the step surface ST1 form a continuous surface SR1. The continuous surface SR1 is disconnected at a middle region Rc in the toe-heel direction. The recess part RE1 is disconnected at the middle region Rc in the toe-heel direction. The step surface ST1 is disconnected at the middle region Rc in the toe-heel direction.

The middle region Rc in the toe-heel direction is described as follows. When a position separated by 10 mm toward the toe side from the face center fc is defined as Pt, and a position separated by 10 mm toward the heel side from the face center fc is defined as Ph, the middle region in the toe-heel direction means a region between the position Pt and the position Ph. These "10 mm" is measured along the toe-heel reference direction.

The recess part RE1 and the step surface ST1 include a first portion 204 that extends toward the toe side to reach a side part from the middle region in the toe-heel direction, and a second portion 206 that extends toward the heel side to reach the side part from the middle region in the toe-heel direction. The recess part RE1 is not formed between the first portion 204 and the second portion 206, and neither is the step surface ST1. The middle region Rc in the toe-heel direction of the crown c12 includes a region in the toe-heel reference direction in which neither the recess part RE1 nor the step surface ST1 is present. This structure is effective in a case where, for example, the coefficient of restitution (COR) near the face center fc is excessively large. This structure can enhance the COR around the face while suppressing the COR near the face center fc. Therefore, equalization in distribution of COR is achieved.

In a head h13 of FIG. 19(*c*), a crown c13 includes a step surface ST1 extending in the toe-heel direction, and a recess part RE1 extending along the step surface ST1. The recess part RE1 is shorter than the step surface ST1. The recess part RE1 is provided along a middle part of the step surface ST1. The recess part RE1 is provided on the middle region Rc in the toe-heel direction. In this structure, the COR near the face center fc can be particularly enhanced. This structure can selectively enhance deformation of the crown c13 near the face center fc.

Figure 20A:
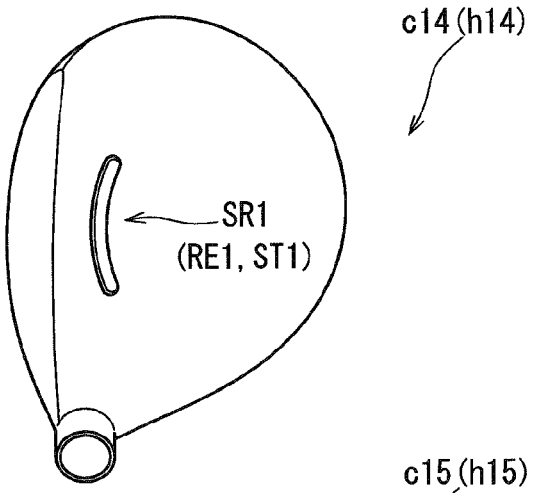
FIG. 20(*a*) shows a plan view of a head according to a fourteenth embodiment, FIG. 20(*b*) shows a plan view of a head according to a fifteenth embodiment, and FIG. 20(*c*) shows a plan view of a head according to a sixteenth embodiment.
Figure 20B:
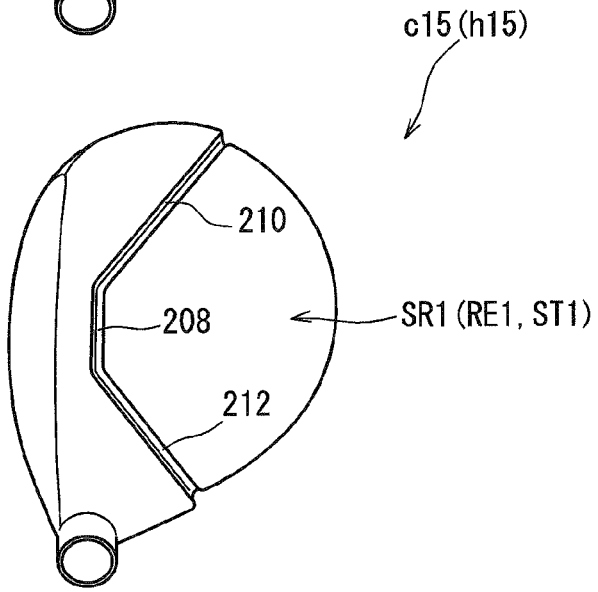
Figure 20C:
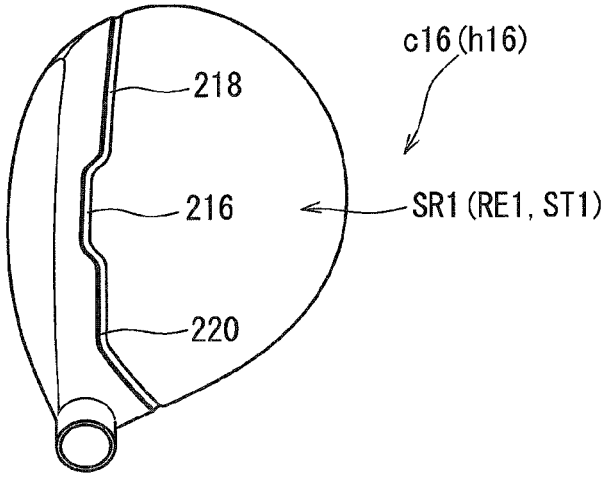

In a head h14 of FIG. 20(*a*), a crown c14 includes a recess part RE1 and a step surface ST1. The recess part RE1 and the step surface ST1 form a continuous surface SR1. The recess part RE1 and the step surface ST1 does not cut across the crown c14. Toe ends of the recess part RE1 and the step surface ST1 do no reach a side part. Heel ends of the recess part RE1 and the step surface ST1 do not reach the side part. The recess part RE1 is shorter than the face length. The step surface ST1 is shorter than the face length. The recess part RE1 and the step surface ST1 can partially promote deformation of the crown c14.

The recess part RE1 and the step surface ST1 are provided on the middle region Rc in the toe-heel direction. This structure can selectively enhance the COR in middle region Rc in the toe-heel directionally. This structure can selectively enhance deformation of the crown c14 near the face center fc.

In the planer view, the step surface ST1 and the recess part RE1 are curved so as to protrude toward the face side. For this reason, the distance T (see FIG. 2) is gradually varied. By varying the distance T, deformation of the crown c14 is controlled at each position in the toe-heel reference direction.

In a head h15 of FIG. 20(*b*), a crown c15 includes a recess part RE1 and a step surface ST1. The recess part RE1 and the step surface ST1 form a continuous surface SR1. The recess part RE1 and the step surface ST1 include a first portion 208, a second portion 210 connected to the toe side of the first portion 208, and a third portion 212 connected to the heel side of the first portion 208. The second portion 210 slopingly extends to be positioned on a further toe side as going backward. The third portion 212 slopingly extends to be positioned on a further heel side as going backward. In comparison between the distances T (see FIG. 2), the distance T of the first portion 208 is shorter than the distance T of the second portion 210. The distance T of the first portion 208 is shorter than the distance T of the third portion 212. In the second portion 210, the distance T becomes longer as going to the toe side. In the third portion 212, the distance T becomes longer as going to the heel side. Because of the distribution of the distance T, deformation of the crown c15 is controlled at each position in the toe-heel reference direction. The toe-heel directional region of the first portion 208 includes the face center fc. In this structure, the crown c15 is largely deformed at the face center fc.

In a head h16 of FIG. 20(*c*), a crown c16 includes a recess part RE1 and the step surface ST1. The recess part RE1 and the step surface ST1 form a continuous surface SR1. The recess part RE1 and the step surface ST1 include a first portion 216, a second portion 218 connected to the toe side of the first portion 216, and a third portion 220 connected to the heel side of the first portion 216. In comparison between the distances T (see FIG. 2), the distance T of the first portion 216 is shorter than the distance T of the second portion 218. The distance T of the first portion 216 is shorter than the distance T of the third portion 220. Because of the distribution of the distance T, deformation of the crown c16 is controlled at each position in the toe-heel reference direction. The first portion 216 is positioned on the face center fc. In this structure, the crown c16 is particularly largely deformed at the face center fc.

Figure 21:
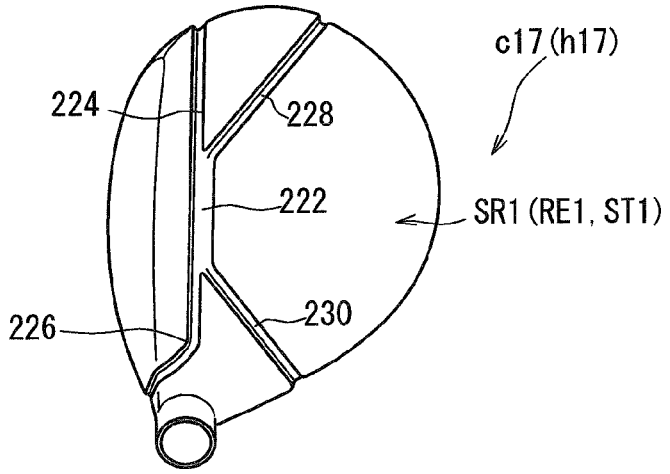
FIG. 21(*a*) shows a plan view of a head according to a seventeenth embodiment, FIG. 21(*b*) shows a plan view of a head according to an eighteenth embodiment, and FIG. 21(*c*) shows a plan view of a head according to a nineteenth embodiment.
Figure 21:
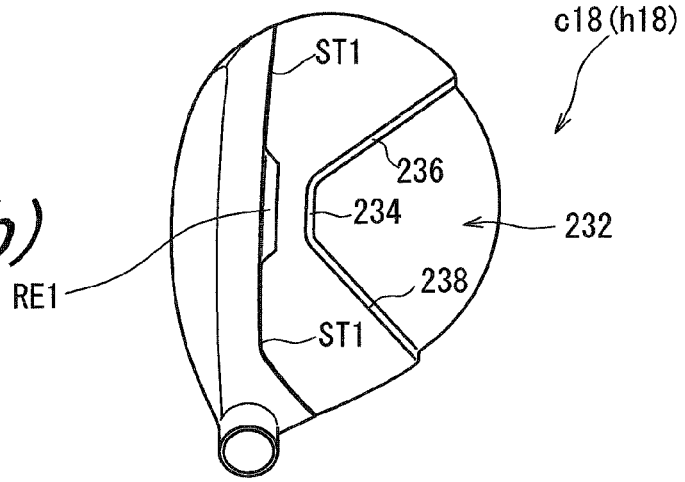
Figure 21:
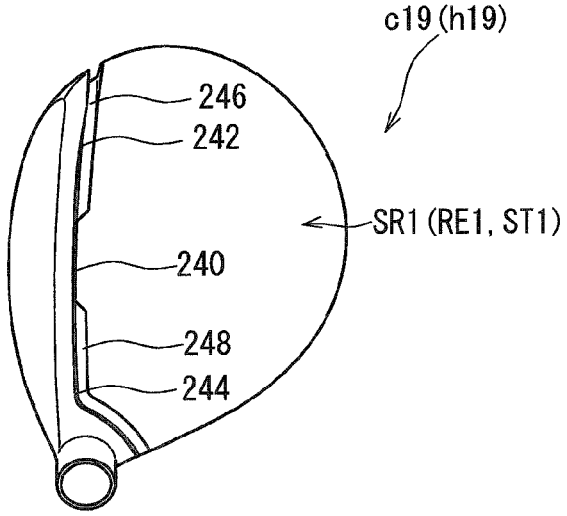

In a head h17 of FIG. 21(*a*), the crown c17 includes a recess part RE1 and a step surface ST1. The recess part RE1 and the step surface ST1 form a continuous surface SR1. The recess part RE1 and the step surface ST1 include a first portion 222, a second portion 224 connected to the toe side of the first portion 222, and a third portion 226 connected to the heel side of the first portion 222. The recess part RE1 and the step surface ST1 further include a fourth portion 228 connected to the toe side of the first portion 222, and a fifth portion 230 connected to the heel side of the first portion 222. The fourth portion 228 is provided at a back of the second portion 224. The fifth portion 230 is provided at a back of the third portion 226.

The fourth portion 228 slopingly extends to be positioned on a further toe side as going backward. The fifth portion 230 slopingly extends to be positioned on a further heel side as going backward.

The first portion 222 is provided on the middle region Rc in the toe-heel direction. The first portion 222 has a recess-part width greater than recess-part widths of other portions. The greater recess-part width promotes deformation of the crown c17.

In a head h18 of FIG. 21(*b*), a crown c18 includes a recess part RE1 and a step surface ST1 (a first step surface). The crown c18 further includes a second step surface 232. The step surface 232 is provided on a back of the step surface ST1. The step surface 232 includes a first portion 234, a second portion 236 connected to the toe end of the first portion 234, and a third portion 238 connected to the heel end of the first portion 234.

The first portion 234 is provided on the middle region Rc in the toe-heel direction. The first portion 234 is closer to the first step surface ST1 than the second portion 236. The first portion 234 is closer to the first step surface ST1 than the third portion 238. Therefore, in a region in which the first portion 234 is present, deformation of the crown c18 is likely to be increased. By a synergistic effect of the two step surfaces, deformation of the crown c18 can be controlled at each position in the toe-heel reference direction.

In a portion positioned at a back of the step surface 232, the height of the crown c18 is suppressed. The lower portion contributes to lowering the center of gravity of the head.

In a head h19 of FIG. 21(*c*), a crown c19 includes a recess part RE1 and a step surface ST1. The step surface ST1 includes a first portion 240, a second portion 242 connected to the toe side of the first portion 240, and a third portion 244 connected to the heel side of the first portion 240. The recess part RE1 includes a toe portion 246 provided along the second portion 242, and a heel portion 248 provided along the third portion 244. A recess part RE1 along the first portion 240 is not provided.

Thus, the step surface ST1 includes portions 242 and 244 accompanied with the recess part RE1, and a portion 240 not accompanied with the recess part RE1. Because of absence of the recess part RE1, deformation of the crown c19 is relatively suppressed in a region in which the first portion 240 is present. This structure can contribute to equalization of the COR.

Figure 22A:
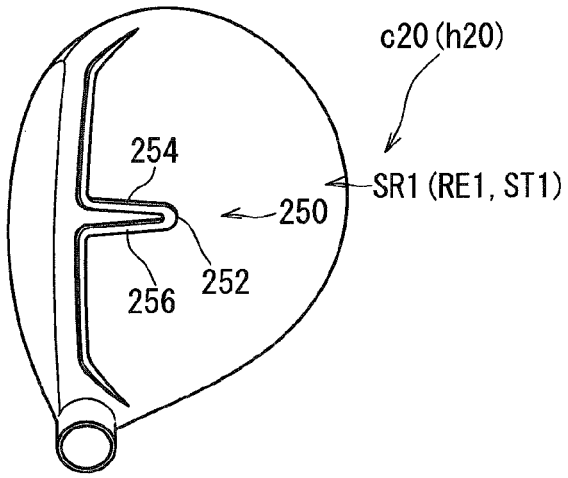
FIG. 22(*a*) shows a plan view of a head according to a twentieth embodiment, FIG. 22(*b*) shows a plan view of a head according to a twenty first embodiment, and FIG. 22(*c*) shows a plan view of a head according to twenty second embodiment.
Figure 22B:
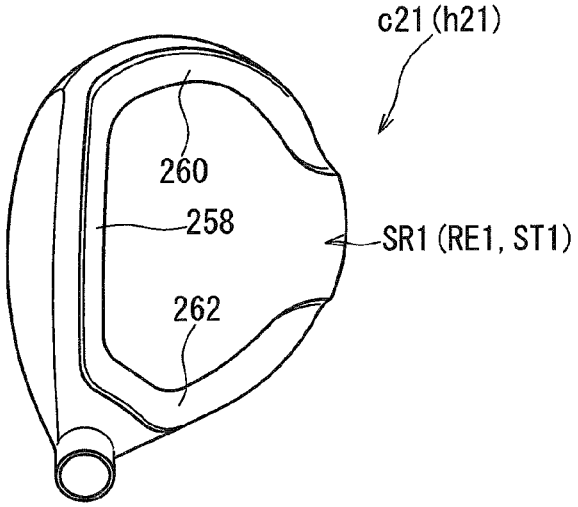
Figure 22C:
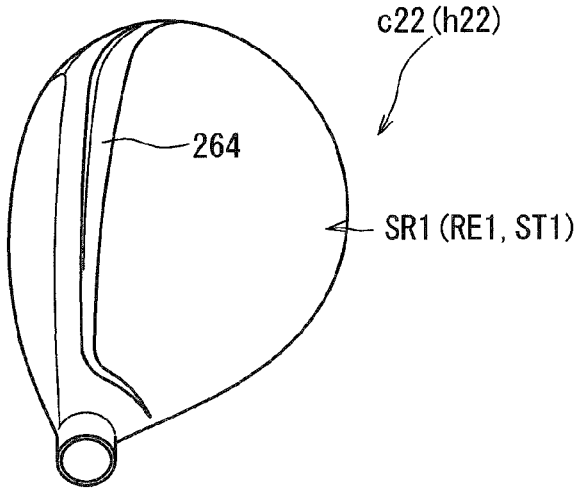

In a head h20 of FIG. 22(*a*), a crown c20 includes a recess part RE1 and a step surface ST1. The recess part RE1 and the step surface ST1 include a bent part 250 that is bent so as to be recessed backward. The bent part 250 is provided on the middle region Rc in the toe-heel direction. The bent part 250 includes a first portion 254 that extends toward the toe side from a vertex 252, and a second portion 256 that extends toward the heel side from the vertex 252. Because of the bent part 250, the recess part RE1 and the step surface ST1 are long. The long recess part RE1 and the long step surface ST1 can promote deformation of the crown c19.

In a head h21 of FIG. 22(*b*), a crown c21 includes a recess part RE1 and a step surface ST1. The recess part RE1 and the step surface ST1 include a first portion 258, a second portion 260 connected to the toe end of the first portion 258, and a third portion 262 connected to the heel end of the first portion 258. The second portion 260 includes a portion that extends in the front-back direction. The back end of the second portion 260 reaches a side part. The third portion 262 includes a portion that extends in the front-back direction. The back end of the third portion 262 reaches the side part. In the head, since the recess part RE1 has a wide width, deformation of the crown c21 is promoted.

In a head h22 of FIG. 22(*c*), a crown c22 includes a recess part RE1 and a step surface ST1. The recess part RE1 includes a width-variation part 264 of which the recess-part width is increased as going to the toe side. The recess-part width is an opening width of the recess part, and is measured along the front-back reference direction. This structure can promote deformation in the toe side.

Figure 23A:
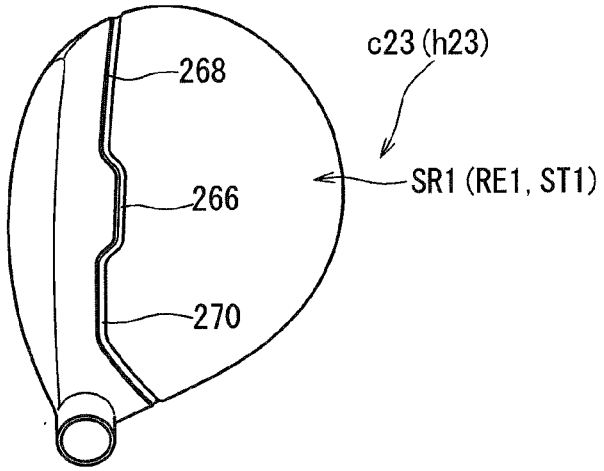
FIG. 23(*a*) shows a plan view of a head according to a twenty third embodiment, FIG. 23(*b*) shows a plan view of a head according to a twenty fourth embodiment, and FIG. 23(*c*) shows a plan view of a head according to a twenty fifth embodiment.
Figure 23B:
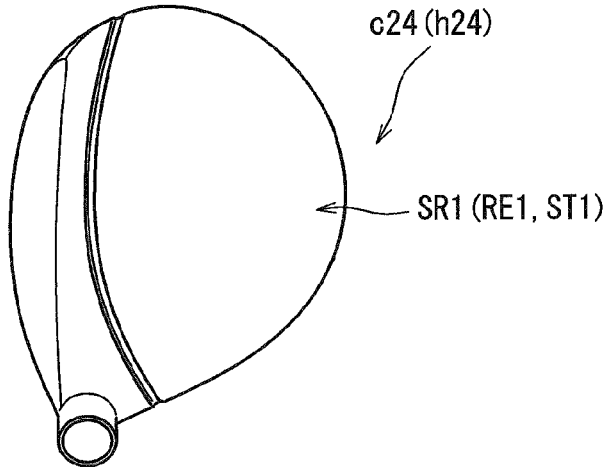
Figure 23C:
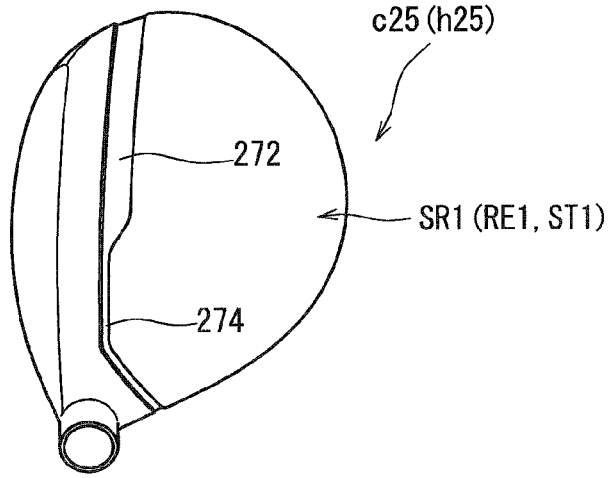

In a head h23 of FIG. 23(*a*), a crown c23 includes a recess part RE1 and a step surface ST1. The recess part RE1 and the step surface ST1 include a first portion 266, a second portion 268 connected to the toe side of the first portion 266, and a third portion 270 connected to the heel side of the first portion 266. The distance T (see FIG. 2) of the first portion 266 is greater than the distance T of the second portion 268. The distance T of the first portion 266 is greater than the distance T of the third portion 270. The first portion 266 is positioned in middle region Rc in the toe-heel direction. Because of the greater distance T, deformation of the middle region Rc in the toe-heel direction is suppressed.

In a head h24 of FIG. 23(*b*), a crown c24 includes a recess part RE1 and a step surface ST1. Toe ends of the recess part RE1 and the step surface ST1 reach a side part. Heel ends of the recess part RE1 and the step surface ST1 reach the side part. In the planer view, the step surface ST1 and the recess part RE1, as a whole, are curved so as to protrude toward the face side. For this reason, the distance T (see FIG. 2) is gradually varied. By varying the distance T, deformation of the crown c24 is controlled at each position in the toe-heel reference direction.

In a head h25 of FIG. 23(*c*), a crown c25 includes a recess part RE1 and a step surface ST1. Toe ends of the recess part RE1 and the step surface ST1 reach a side part. Heel ends of the recess part RE1 and the step surface ST1 reach the side part. The recess part RE1 includes a first portion 272 and a second portion 274. The first portion 272 is connected to the toe end of the second portion 274. The recess-part width of the first portion 272 is greater than the recess-part width of the second portion 274. In a region in which the first portion 272 is present, deformation of the crown c25 is further promoted.

In a head h26 of FIG. 24(*a*), a crown c26 includes a recess part RE1 and a step surface ST1. The recess part RE1 and the step surface ST1 include a first portion 276, a second portion 278 connected to the toe side of the first portion 276, and a third portion 280 connected to the heel side of the first portion 276. The distance T (see FIG. 2) of the first portion 276 is greater than the distance T of the second portion 278. The distance T of the first portion 276 is greater than the distance T of the third portion 280. The first portion 276 is positioned on the middle region Rc in the toe-heel direction. In the planer view, the first portion 276 is curved so as to protrude backward. Based on the variation of the distance T, deformation is controlled at each position in the toe-heel reference direction.

In a head h27 of FIG. 24(*b*), a crown c27 includes a recess part RE1 and a step surface ST1. The recess part RE1 and the step surface ST1 include a first portion 282, a second portion 284 connected to the toe side of the first portion 282, and a third portion 286 connected to the heel side of the first portion 282. The recess-part width of the first portion 282 is greater than the recess-part width of the second portion 284. The recess-part width of the first portion 282 is greater than the recess-part width of the third portion 286. Because of the greater recess-part width, the crown c27 is largely deformed in a region in which the first portion is present.

Toe ends of the recess part RE1 and the step surface ST1 reach a side part. Heel ends of the recess part RE1 and the step surface ST1 do not reach the side part. Therefore, the toe side is largely deformed as compared with the heel side.

In a head h28 of FIG. 24(*c*), a crown c28 includes a recess part RE1 and a step surface ST1 (first step surface). The crown c28 further includes a second step surface 288, a third step surface 290, and a fourth step surface 292. The plurality of step surfaces stepwise lower the up-down directional position of the crown c28. The head h28 has a low center of gravity of the head.

Figure 25:
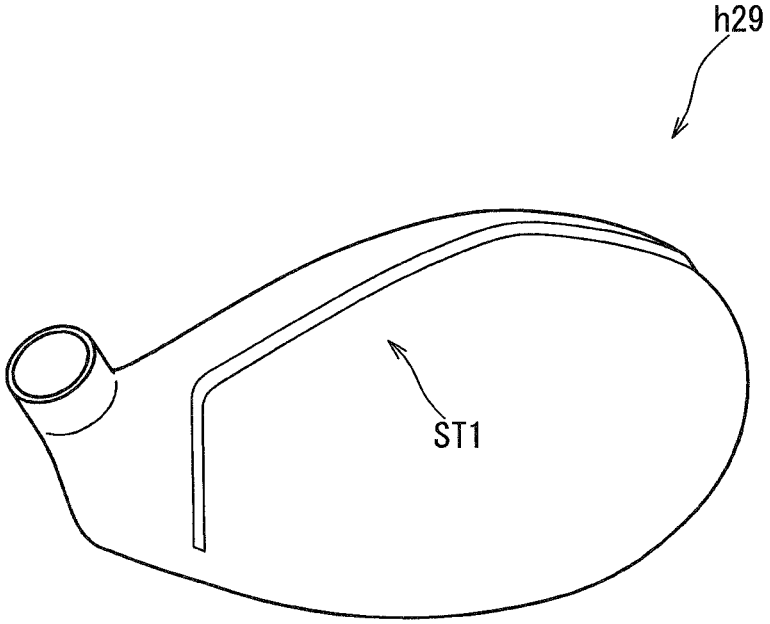
FIG. 25 shows a perspective view of a head according to a twenty ninth embodiment.
Figure 26:
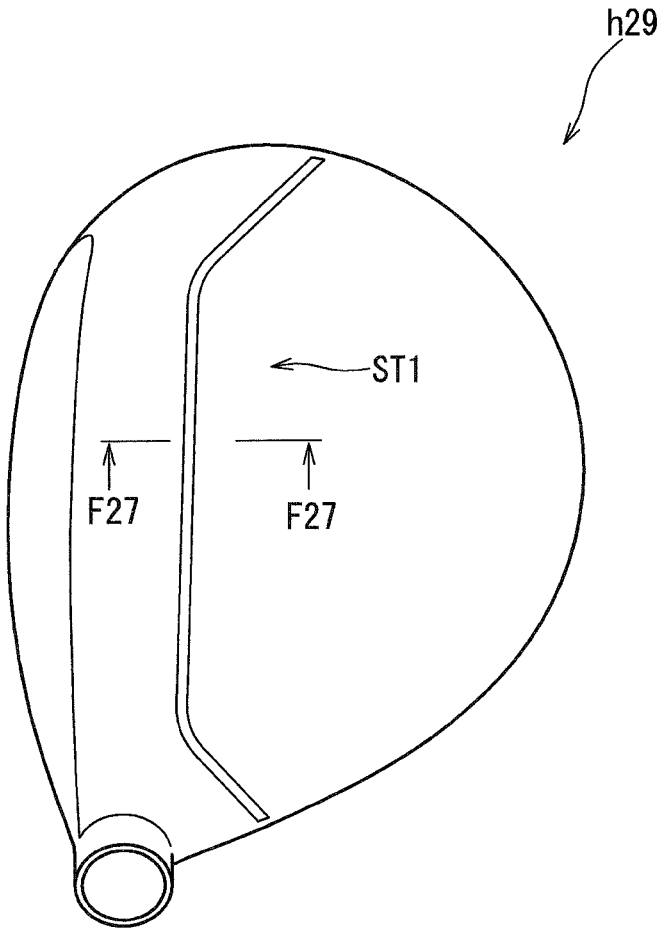
FIG. 26 shows a plan view of the head in FIG. 25.
Figure 27:
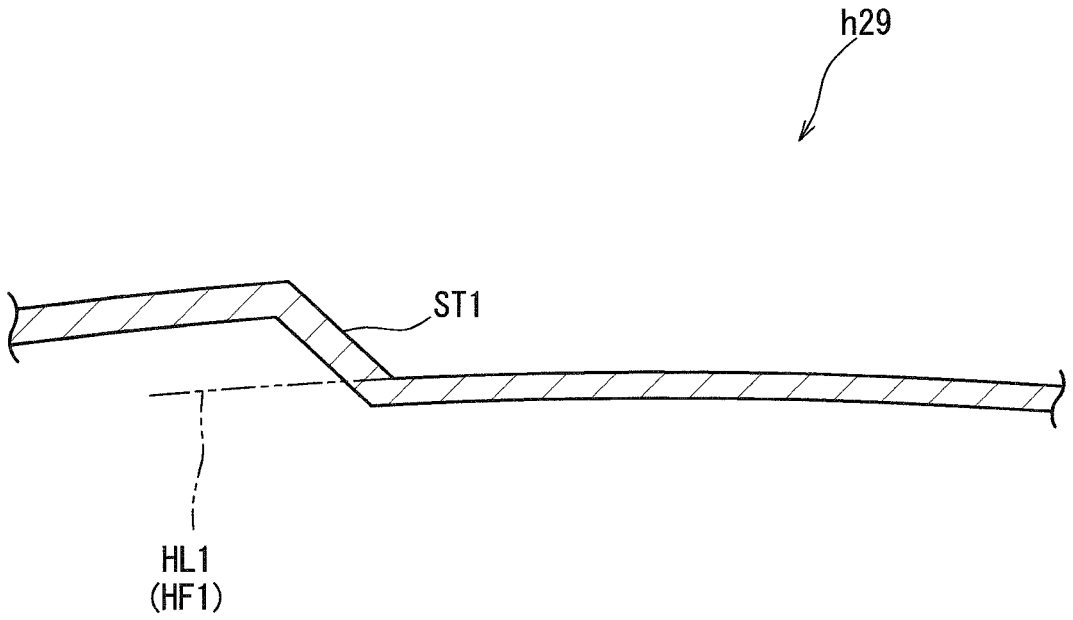
FIG. 27 shows a cross-sectional view taken along line F27-F27 in FIG. 26.

FIG. 25 shows a perspective view of a head h29. FIG. 26 shows a plan view of the head h29. FIG. 27 shows a cross-sectional view taken along line F27-F27 in FIG. 26.

The head h29 does not include a recess part RE1. The head h29 includes a step surface ST1. As shown in FIG. 27, the step surface ST1 is an inclined surface. The step surface ST1 is inclined to be closer to the face side as going upward. As described later, in a set of the present invention, a head not having a recess part RE1 can be used.

Figure 28:
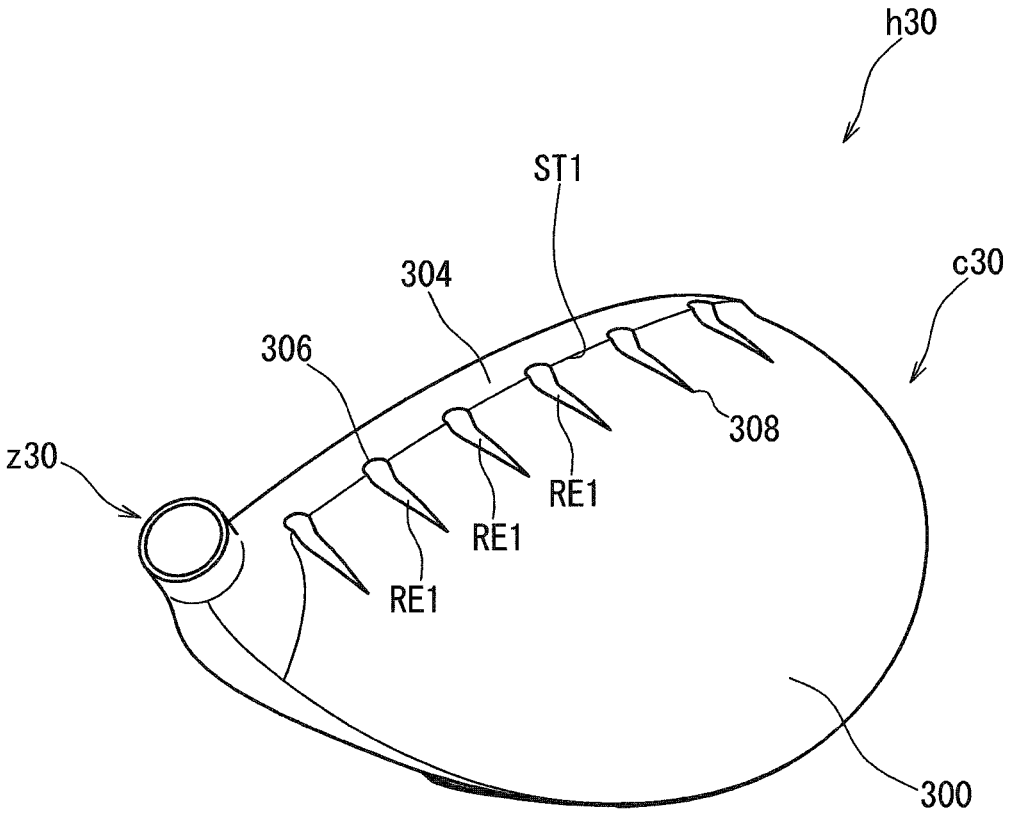
FIG. 28 shows a perspective view of a head according to a thirtieth embodiment.
Figure 29:
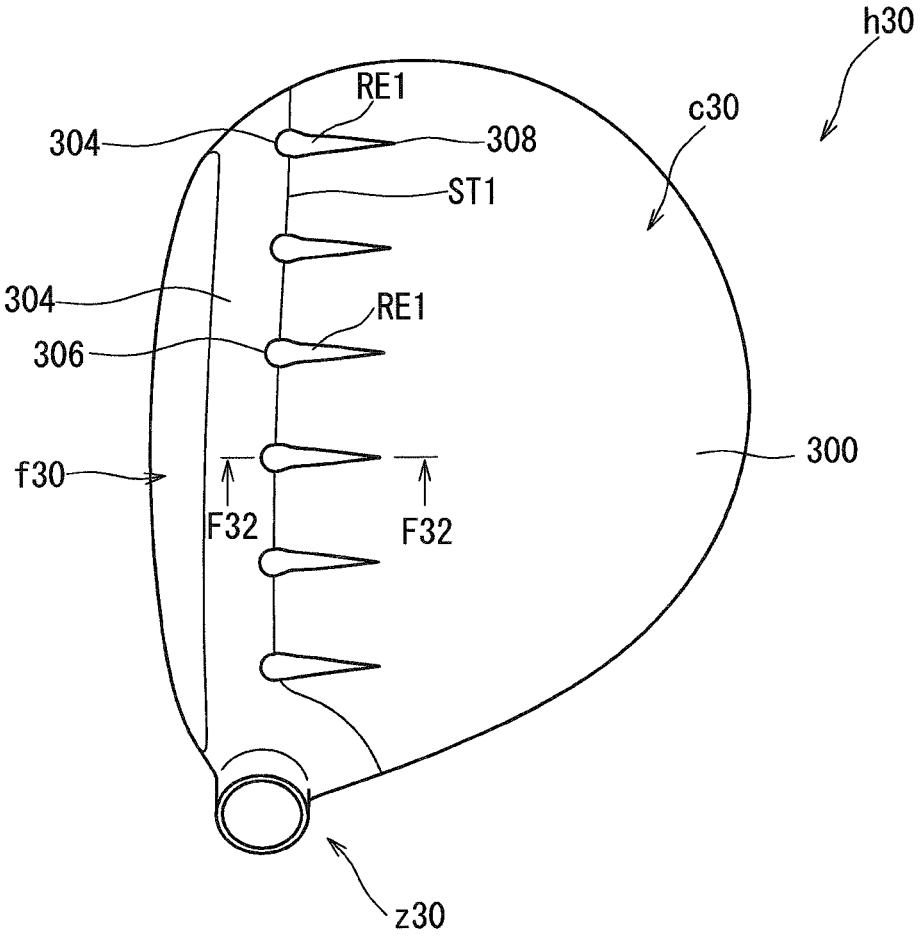
FIG. 29 shows a plan view of the head in FIG. 28.
Figure 30:
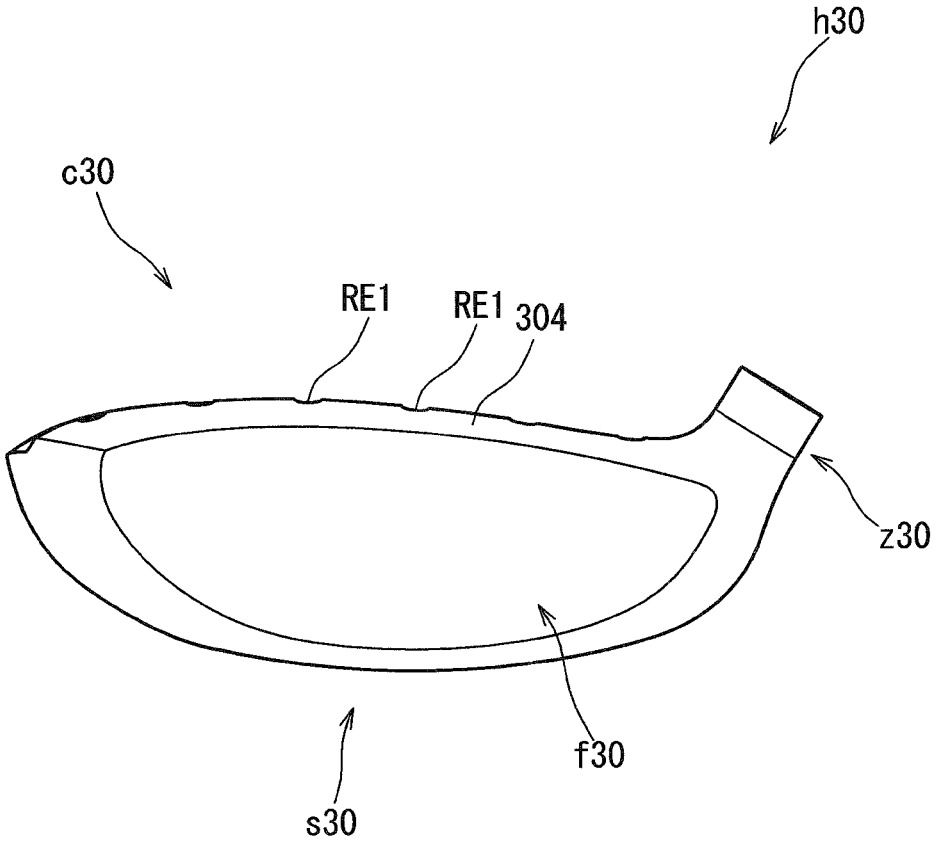
FIG. 30 shows a front view of the head in FIG. 28.
Figure 31:
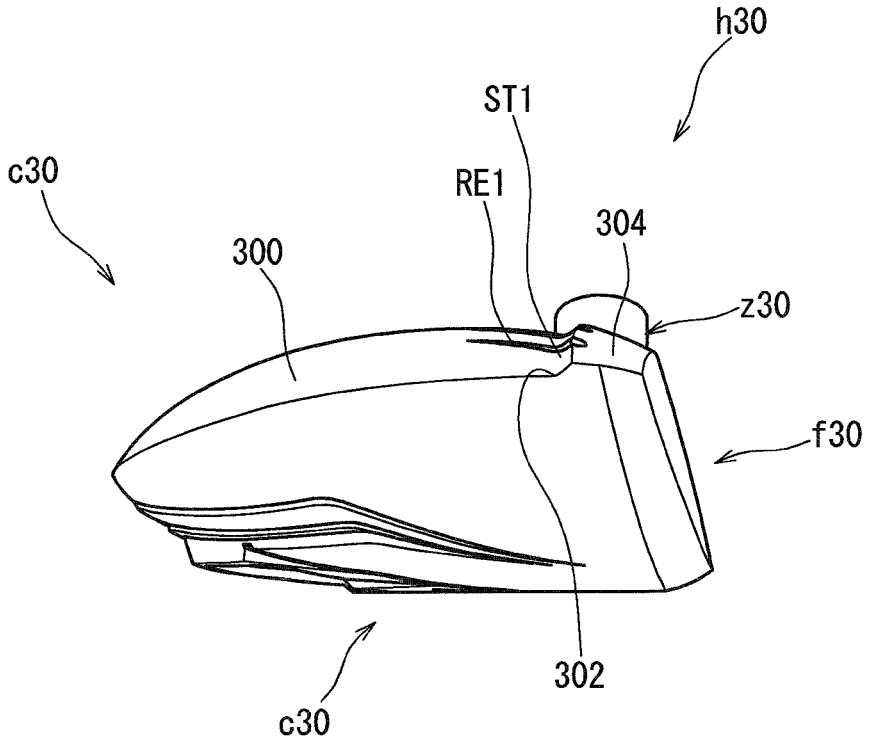
FIG. 31 shows a toe-side view of the head in FIG. 28.
Figure 32:
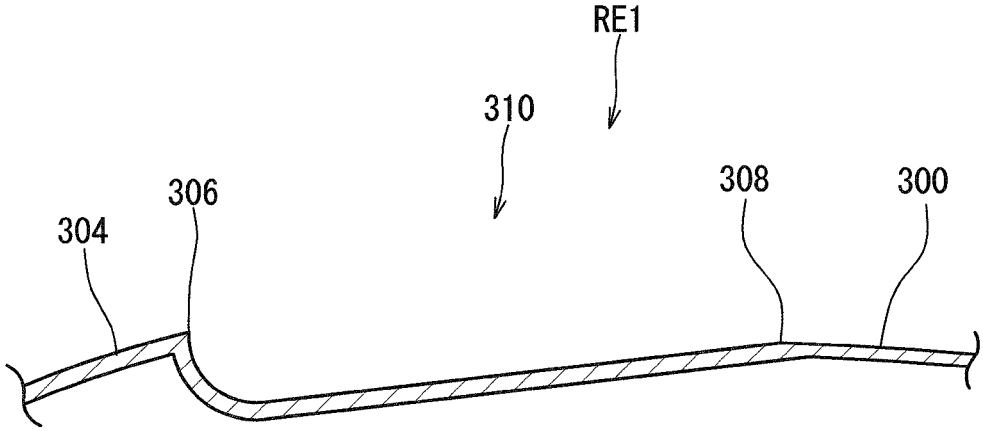
FIG. 32 shows a cross-sectional view taken along line F32-F32 in FIG. 29.

FIG. 28 shows a perspective view of a head h30. FIG. 29 shows a plan view of the head h30. FIG. 30 shows a front view of the head h30. FIG. 31 shows a toe-side view of the head h30. FIG. 32 is a cross-sectional view taken along line F32-F32 in FIG. 29.

The head h30 includes a crown c30, a sole s30, a face f30, and a hosel z30.

The crown c30 includes a back part 300, a step surface ST1 positioned at a front of the back part 300 and positioned above the virtual extension surface of the back part 300, and a recess part RE1 extending in the front-back direction. The crown c30 further includes a front part 304 positioned at a front of the step surface ST1.

When the extending direction of the recess part RE1 is unclear, the extending direction of the width-directional center line of the recess part RE1 can be regard as the extending direction of the recess part RE1. The width-directional center line is a set of central points in the toe-heel reference direction.

The definition of the virtual extension surface is as described above. In the present embodiment, the point Pa is a front end 302 of the back part 300. The front end 302 is a boundary between the back part 300 and the step surface ST1. The boundary is determined on a cross section along the front-back reference direction. When the boundary is unclear, a central point of a portion having the smallest curvature radius in the cross section is set to the front end 302.

A plurality of the recess parts RE1 are provided. The recess parts RE1 are provided at respective toe-heel reference directional positions.

The plurality of recess parts RE1 include the recess part RE1 positioned on the middle region Rc in the toe-heel direction (see FIG. 19(*b*)). The plurality of recess parts RE1 include the recess part RE1 positioned on the toe side with respect to the middle region Rc in the toe-heel direction. The plurality of recess parts RE1 include the recess part RE1 positioned on the heel side with respect to the middle region Rc in the toe-heel direction.

The recess part RE1 intersects the step surface ST1. In other words, a front end 306 of the recess part RE1 is positioned at a front of the step surface ST1 or positioned on the step surface ST1, and a back end 308 of the recess part RE1 is positioned at a back of the step surface ST1.

The recess part RE1 includes a depth-variation part 310 having a depth D of decreasing as going backward. The depth D of the recess part RE1 extending in the front-back direction is measured on a cross section along the toe-heel reference direction. In the cross section (not shown in the drawings), the depth D is determined based on a straight line covering the opening of the recess part RE1. The depth-variation part 310 extends to reach the back end 308. The depth D at the back end 308 is zero. The depth-variation part 310 can disperse stress that acts on the step surface ST1 when the crown c30 is deformed. Therefore, durability of the step surface ST1 can be improved.

The recess part RE1 that extends in the front-back direction promotes deformation of the crown c30. At impact, the crown c30 is compressed in the front-back direction. In conjunction with the compressive deformation, the crown c30 is deformed so that a top part thereof is upwardly swelled. The deformation is also referred to as a swelling deformation. The swelling deformation includes an elongated deformation in which the crown c30 is elongated in the toe-heel direction. The recess part RE1 extending in the front-back direction can function as a room of elongation for the elongated deformation. As a result, the recess part RE1 extending in the front-back direction promotes the deformation of the crown c30 at impact. Therefore, also in the crown c30, the effect of promoting deformation is exhibited. In addition, the step-surface effect is exhibited because of the step surface ST1.

The material of the head is not limited. Examples of the material of the head include a metal, CFRP (carbon fiber reinforced plastic), and the like. Examples of the metal include one or more kinds selected from soft iron, pure titanium, a titanium alloy, stainless steel, maraging steel, an aluminium alloy, a magnesium alloy, and a tungsten-nickel alloy. Examples of the stainless steel include SUS630 and SUS304. Examples of the titanium alloy include 6-4 titanium (Ti-6Al-4V), Ti-15V-3Cr-3Sn-3Al, Ti-6-22-22S, and the like. The soft iron means low carbon steel having a carbon content of less than 0.3 wt %.

The volume of the head is not limited. In a small head, the crown is less likely to be deformed. Therefore, the present invention is effective in a head having a small volume. In this respect, the volume of the head is preferably equal to or less than 470 cc, and more preferably equal to or less than 300 cc. In view of a sweet area, the volume of the head is preferably equal to or greater than 90 cc.

The height (SS height) of a sweet spot is no limited. In a head having a low center of gravity, dropping of a golf ball during flight is likely to occur in the upper-side hitting due to insufficient backspin. Therefore, the present invention is effective in a head having a low center of gravity. In this respect, when the SS height is defined as Hs (mm), and the height of the face center fc is defined as Hc (mm), then a difference (Hs−Hc) is preferably equal to or less than 8 mm, and more preferably equal to or less than 6 mm. The height Hs is measured along the up-down direction of the head in the reference state. The height Hc is measured along the up-down direction of the head in the reference state. The difference (Hs−Hc) is preferably equal to or greater than 4 mm.

As mentioned above, the present invention is effective in a head having a low center of gravity. In this respect, the SS height Hs is preferably equal to or less than 26 mm, and more preferably equal to or less than 25 mm. The SS height Hs is preferably equal to or greater than 24 mm.

The recess part RE1 may be painted by the same color as a color of other parts of the crown. In this case, the recess part RE1 becomes inconspicuous. The presence of the recess part RE1 may cause a visually uncomfortable feeling at address. The painting can suppress the visually uncomfortable feeling.

The recess part RE1 may be painted by the same color as a color of other parts of the crown, and only the recess part RE1 may be subjected to matte painting. The matte painting suppresses a gloss. Therefore, the visually uncomfortable feeling can be further suppressed.

[Embodiments of Golf Club Sets]

The present application includes an invention of a golf club set. The above described heads can be used for the golf club set. The set includes at least one of the heads.

Figure 33:
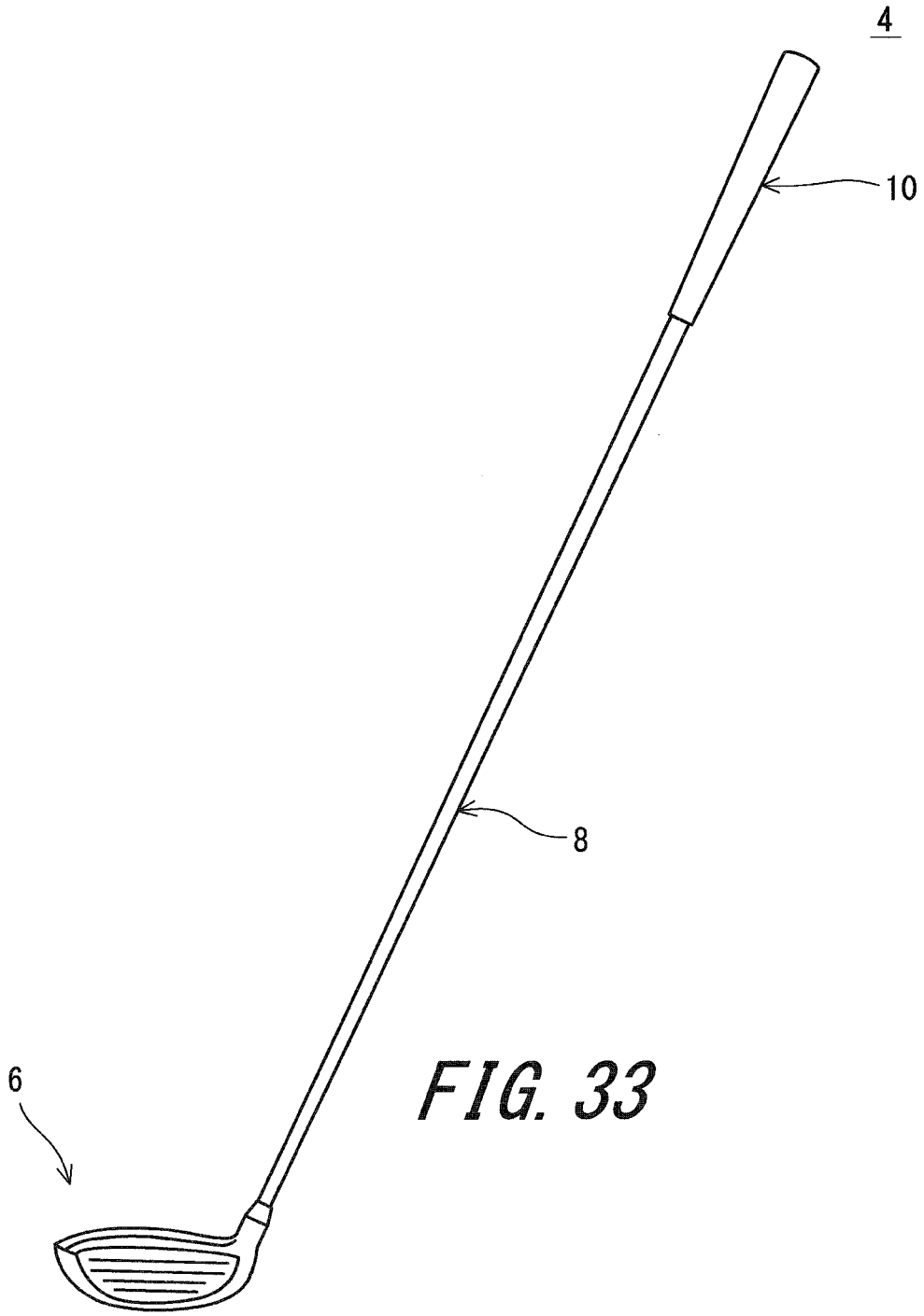
FIG. 33 shows a club according to an embodiment of the present invention.

FIG. 33 shows a golf club 4. The golf club 4 includes a head 6, a shaft 8, and a grip 10. The head 6 is attached to a tip part of the shaft 8. The grip 10 is attached to a butt part of the shaft 8.

Figure 34:
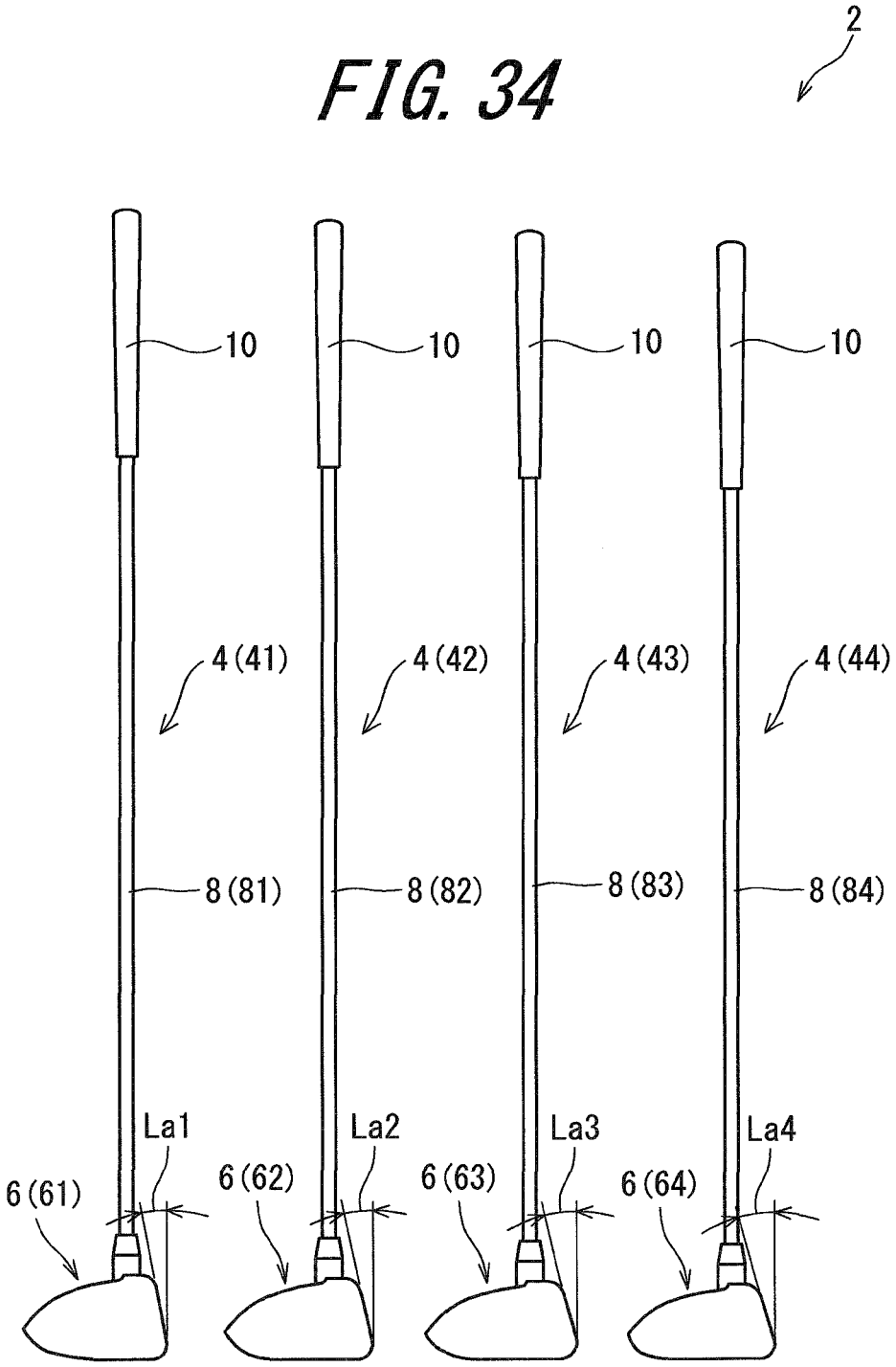
FIG. 34 shows a club set according to an embodiment of the present invention.

FIG. 34 shows a golf club set 2. The set 2 includes a plurality of golf clubs 4. The set 2 of the present embodiment includes four golf clubs 4. Each golf club 4 includes a head 6, a shaft 8, and a grip 10.

The number of clubs 4 in the set 2 is equal to or greater than 2. In view of the restriction on the number of clubs in the rule, the number of the clubs 4 in the set 2 is preferably equal to or less than 8, more preferably equal to or less than 7, and still more preferably equal to or less than 6. The set 2 may not include a driver (a number 1 wood). The set 2 may be constituted with clubs of only FW category. The set 2 may be constituted with clubs of only HB category. The set 2 may be constituted with a club of FW category and a club of HB category only. The set 2 may include a driver. In a set described later, the number of clubs is indicated by an integer N, an integer M or an integer Q.

In the set 2, the type of the head 6 is not limited. The head 6, for example, may be wood type or hybrid type. A wood type head and a hybrid type head may be used in combination.

In the present embodiment, the set 2 includes a club 41, a club 42, a club 43 and a club 44 in an order from the club having the smallest loft angle. The club 41 has a head 61. The club 42 has a head 62. The club 43 has a head 63. The club 44 has a head 64. The club 41 has a shaft 81. The club 42 has a shaft 82. The club 43 has a shaft 83. The club 44 has a shaft 84.

As shown in FIG. 34, the real loft R of the club 41 is shown by a double-pointed arrow La1. The real loft R of the club 42 is shown by a double-pointed arrow La2. The real loft R of the club 43 is shown by a double-pointed arrow La3. The real loft R of the club 44 is shown by a double-pointed arrow La4. Magnitude relationship between the real lofts R is La1<La2<La3<La4. The set 2 satisfies the following relationship A.

[Relationship A]: The shorter the club length is, the greater the real loft R is.

The set according to the present invention may not satisfy the relationship A. For example, it is common for a set including a club of HB category and a club of FW category in combination not to satisfy the relationship A.

At least one of the heads 61 to 64 which constitute the set 2 includes the recess part RE1 and the step surface ST1. All of the heads 61 to 64 which constitute the set 2 may include the recess part RE1 and the step surface ST1.

The set 2 may include a head that does not have the recess part RE1 and that has the step surface ST1. An example for this head is the head h29 (FIG. 25).

In the set 2, the depth D and the height H for each club number may be different from those of other club numbers. The difference is useful for optimizing the function for each club number.

Table 1 below shows specifications of a club set A of a first embodiment. The set A includes a club of FW category and a club of HB category. The set A includes a club having a depth D of zero.

TABLE 1

Table 1 Specifications of set A

| | | Real loft R (degree) | Club length L (inch) | Height H (mm) | Recess-part depth D (mm) | X (R/L) | Y (D × H) |
|---|---|---|---|---|---|---|---|
| Set A1 | #3 | 15 | 43 | 1.5 | 0 | 0.35 | 0.00 |
| (FW | #4 | 17 | 42.75 | 1.5 | 0 | 0.40 | 0.00 |
| category) | #5 | 19 | 42.5 | 1.5 | 1 | 0.45 | 1.50 |
| | #7 | 21 | 42 | 1.5 | 2 | 0.50 | 3.00 |
| Set A2 | #2 | 16 | 40.75 | 1.5 | 1 | 0.39 | 1.50 |
| (HB | #3 | 19 | 40.25 | 1.5 | 2 | 0.47 | 3.00 |
| category) | #4 | 22 | 39.75 | 1.5 | 3 | 0.55 | 4.50 |
| | #5 | 25 | 39.25 | 1.5 | 3 | 0.64 | 4.50 |

The set A includes a club set A1 of FW category. The set A1 includes a plurality of clubs belonging to FW category. Specifically, the set A1 includes four clubs belonging to FW category. Heads used for the set A1 have the same structure as the head h1. As described later, however, the set A1 includes clubs having a recess-part depth D of zero.

In the set A1, the greater the real loft R is, the shorter the club length L is. In the set A1, the heights H are constant. In the set A1, the depths D are varied. In the set A1, as the club length L becomes shorter, the depth D tends to be greater.

In the recess part RE1 extending in the toe-heel direction, the recess-part depth D means a depth from the virtual extension line HL1. The recess-part depth D is measured along the up-down direction.

The height H is also measured along the up-down direction. The height H is a height from the virtual extension line HL1.

When the number of clubs of the set A1 is defined as N (N is an integer of equal to or greater than 2), and the recess-part depths D of the clubs are defined as D1, D2, . . . , Dn in an order from the club having the greatest length L, the set A1 satisfies the following relationship F1.

[Relationship F1]: D1≤D2≤ . . . ≤Dn, and D1<Dn

A value (R/L) obtained by dividing the loft R (degree) by the length L (inch) is defined as X. A product of the depth D (mm) and the height H (mm) is defined as Y. A club having a shorter length L has a greater X.

The number of clubs of the set A1 is defined as N (N is an integer of equal to or greater than 2), and Y of the clubs are defined as Y1, Y2, . . . , Yn in an order from the club having the smallest X, the set A1 satisfies the following relationship F2.

[Relationship F2]: Y1≤Y2≤ . . . ≤Yn, and Y1<Yn

The set A includes a club set A2 of HB category. The set A2 includes a plurality of clubs belonging to HB category. Specifically, the set A2 includes four clubs belonging to HB category.

In the set A2, the greater the real loft R is, the shorter the club length L is. In the set A2, the heights H are constant. In the set A2, the depths D are varied. In the set A2, as the club length L becomes shorter, the depth D tends to be greater.

The number of clubs of the set A2 is defined as M (M is an integer of equal to or greater than 2), and the recess-part depths D of the clubs are defined as D1, D2, . . . , Dm in an order from the club having the greatest length L, the set A2 satisfies the following relationship H1.

[Relationship H1]: D1≤D2≤ . . . ≤Dm, and D1<Dm

The number of clubs of the set A2 is defined as M (M is an integer of equal to or greater than 2), and Y of the clubs are defined as Y1, Y2, . . . , Ym in an order from the club having the smallest X, the set A2 satisfies the following relationship H2.

[Relationship H2]: Y1≤Y2≤ . . . ≤Ym, and Y1<Ym

Thus, the embodiment 1 discloses the golf club set A including at least one club of FW category and at least one club of HB category. The set A includes a plurality of clubs of FW category. The set A includes a plurality of clubs of HB category. At least two clubs of the set A can be a golf club set in the present application. For example, the set A1 is a golf club set in the present application. The set A2 is also a golf club set in the present application. At least two clubs of the set A1 can be a golf club set in the present application. At least two clubs of the set A2 can be a golf club set in the present application.

The embodiment 1 discloses the set A1 of FW category which satisfies the relationship F1. The embodiment 1 discloses the set A1 of FW category which satisfies the relationship F2. The embodiment 1 discloses the set A2 of HB category which satisfies the relationship H1. The embodiment 1 discloses the set A2 of HB category which satisfies the relationship H2.

Table 2 below shows specifications of a club set B of a second embodiment. The set B includes a club of FW category and a club of HB category. The set B includes a club having a depth D of zero.

TABLE 2

Table 2 Specifications of set B

| | | Real loft R (degree) | Club length L (inch) | Height H (mm) | Recess-part depth D (mm) | X (R/L) | Y (D × H) |
|---|---|---|---|---|---|---|---|
| Set B1 | #3 | 15 | 43 | 1 | 0 | 0.35 | 0.00 |
| (FW | #4 | 17 | 42.75 | 1.5 | 0 | 0.40 | 0.00 |
| category) | #5 | 19 | 42.5 | 1.5 | 1 | 0.45 | 1.50 |
| | #7 | 21 | 42 | 1.5 | 2 | 0.50 | 3.00 |

TABLE 2-continued

Table 2 Specifications of set B

| | | Real loft R (degree) | Club length L (inch) | Height H (mm) | Recess-part depth D (mm) | X (R/L) | Y (D × H) |
|---|---|---|---|---|---|---|---|
| Set B2 (HB category) | #2 | 16 | 40.75 | 1.5 | 2 | 0.39 | 3.00 |
| | #3 | 19 | 40.25 | 1.5 | 3 | 0.47 | 4.50 |
| | #4 | 22 | 39.75 | 1.5 | 4 | 0.55 | 6.00 |
| | #5 | 25 | 39.25 | 1.5 | 4 | 0.64 | 6.00 |

The set B includes a club set B1 of FW category. The set B1 includes a plurality of clubs belonging to FW category. Specifically, the set B1 includes four clubs belonging to FW category.

In the set B1, the greater the real loft R is, the shorter the club length L is. In the set B1, the heights H are varied.

When the number of clubs of the set B1 is defined as N (N is an integer of equal to or greater than 2), and the heights H of the clubs are defined as H1, H2, . . . , Hn in an order from the club having the greatest length L, the set B1 satisfies the following relationship F3.

[Relationship F3]: H1≤H2≤ . . . ≤Hn, and H1<Hn

In the set B1, the depths D are varied. The set B1 satisfies the relationship F1. The set B1 satisfies the relationship F2.

The set B includes a club set B2 of HB category. The set B2 includes a plurality of clubs belonging to HB category. Specifically, the set B2 includes four clubs belonging to HB category.

In the set B2, the greater the real loft R is, the shorter the club length L is. In the set B2, the heights H are constant. In the set B2, the depths D are varied. The set B2 satisfies the relationship H1. The set B2 satisfies the relationship H2.

Thus, the embodiment 2 discloses the golf club set B including at least one club of FW category and at least one club of HB category. The set B includes a plurality of clubs of FW category. The set B includes a plurality of clubs of HB category. At least two clubs of the set B can be a golf club set in the present application. For example, the set B1 is a golf club set in the present application. The set B2 is a golf club set in the present application. At least two clubs of the set B1 can be a golf club set in the present application. At least two clubs of the set B2 can be a golf club set in the present application.

When the number of clubs of the set B is defined as Q (Q is an integer of equal to or greater than 2), and the depths D of the clubs are defined as D1, D2, . . . , Dq in an order from the club having the greatest length L, the set B satisfies the following relationship FH1.

[Relationship FH1]: D1≤D2≤ . . . ≤Dq, and D1<Dq

When the number of clubs of the set B is defined as Q (Q is an integer of equal to or greater than 2), and Y of the clubs are defined as Y1, Y2, . . . , Yq in an order from the club having the greatest length L, the set B satisfies the following relationship FH2.

[Relationship FH2]: Y1≤Y2≤ . . . ≤Yq, and Y1<Yq

The embodiment 2 discloses the set B1 of FW category which satisfies the relationship F1. The embodiment 2 discloses the set B1 of FW category which satisfies the relationship F2. The embodiment 2 discloses the set B1 of FW category which satisfies the relationship F3. The embodiment 2 discloses the set B2 of HB category which satisfies the relationship H1. The embodiment 2 discloses the set B2 of HB category which satisfies the relationship H2.

Table 3 below shows specifications of a club set C of a third embodiment. The set C includes a driver, a club of FW category and a club of HB category.

TABLE 3

Table 3 Specifications of set C

| | | Real loft R (degree) | Club length L (inch) | Height H (mm) | Recess-part depth D (mm) | X (R/L) | Y (D × H) |
|---|---|---|---|---|---|---|---|
| Driver | #1 | 8.5 | 44.75 | 1 | 1 | 0.19 | 1.00 |
| Set C1 (FW category) | #3 | 15 | 43 | 1.5 | 2 | 0.35 | 3.00 |
| | #4 | 17 | 42.75 | 1.5 | 2 | 0.40 | 3.00 |
| | #5 | 19 | 42.5 | 1.5 | 3 | 0.45 | 4.50 |
| | #7 | 21 | 42 | 1.5 | 3 | 0.50 | 4.50 |
| Set C2 (HB category) | #2 | 16 | 40.75 | 1.5 | 4 | 0.39 | 6.00 |
| | #3 | 19 | 40.25 | 1.5 | 4 | 0.47 | 6.00 |
| | #4 | 22 | 39.75 | 1.5 | 5 | 0.55 | 7.50 |
| | #5 | 25 | 39.25 | 3 | 5 | 0.64 | 15.00 |

The set C includes a driver. A typical driver satisfies the following specifications (3a) to (3e).

(3a) The head has a curved face surface.

(3b) The head has a hollow part.

(3c) The head has a volume of greater than 300 cc but equal to or less than 470 cc.

(3d) The head has a real loft of equal to or greater than 6 degrees but equal to or less than 15 degrees.

(3e) The club length is equal to or longer than 43.5 inches but equal to or shorter than 48 inches.

The set C includes a club set C1 of FW category. The set C1 includes a plurality of clubs belonging to FW category. Specifically, the set C1 includes four clubs belonging to FW category.

In the set C1, the greater the real loft R is, the shorter the club length L is. In the set C1, the heights H are varied. The set C1 satisfies the relationship F3.

In the set C1, the depths D are varied. The set C1 satisfies the relationship F1. The set C1 satisfies the relationship F2.

The set C includes a club set C2 of HB category. The set C2 includes a plurality of clubs belonging to HB category. Specifically, the set C2 includes four clubs belonging to HB category.

In the set C2, the greater the real loft R is, the shorter the club length L is. In the set C2, the heights H are varied.

When the number of clubs of the set C2 is defined as M (M is an integer of equal to or greater than 2), and the heights H of the clubs are defined as H1, H2, . . . Hm in an order from the club having the greatest length L, the set C2 satisfies the following relationship H3.

[Relationship H3]: H1≤H2≤ . . . ≤Hm, and H1<Hm

In the set C2, the depths D are varied. The set C2 satisfies the relationship H1. The set C2 satisfies the relationship H2.

Thus, the embodiment 3 discloses the golf club set C including a driver, at least one club of FW category, and at least one club of HB category. The set C includes one driver. The set C includes a plurality of clubs of FW category. The set C includes a plurality of clubs of HB category. At least two clubs of the set C can be a golf club set in the present application. At least two clubs of the set C1 can be a golf club set in the present application. At least two of the set C2 can be a golf club set in the present application. At least two clubs including a driver and at least one club belonging to FW category or belonging to HB category can be a golf club set in the present application.

The set C satisfies the relationship FH1. The set C satisfies the relationship FH2.

The embodiment 3 discloses the set C including a driver and a club of FW category and/or a club of HB category. In the set C, the height H of the driver is the minimum in comparison between the heights H of the clubs in the set. In the set C, the depth D of the driver is the minimum in comparison between the depths D in the set.

The embodiment 3 discloses the set C1 of FW category which satisfies the relationship F1. The embodiment 3 discloses the set C1 of FW category which satisfies the relationship F2. The embodiment 3 discloses the set C1 of FW category which satisfies the relationship F3. The embodiment 3 discloses the set C2 of HB category which satisfies the relationship H1. The embodiment 3 discloses the set C2 of HB category which satisfies the relationship H2. The embodiment 3 discloses the set C2 of HB category which satisfies the relationship H3.

A request to a club for performance capable of directly aiming at a target (pin) is increased as the club length L of the club becomes shorter. Therefore, it is preferable that a higher launch angle and more backspin are achieved as the club length becomes shorter. By increasing the depth D, the height H, or Y, deformation of the crown is promoted, and thus deformation of increasing the loft angle is likely to occur. This deformation can attain the higher launch angle and more backspin. In these respects, in a set of FW category, a set satisfying the relationship F1 is preferable, a set satisfying the relationship F2 is preferable, and a set satisfying the relationship F3 is preferable. In the same respects, in a set of the HB category, a set satisfying the relationship H1 is preferable, a set satisfying the relationship H2 is preferable, and a set satisfying the relationship H3 is preferable. In the same respects, a set satisfying the relationship FH1 is preferable, and a set satisfying the relationship FH2 is preferable.

Clubs which constitute a set might be purchasable as each single club. However, a group of clubs having respective club numbers different from each other and belonging to the same product class is regarded as a set. Usually, two or more clubs belonging to the group of clubs are purchased at the same time. Therefore, even if clubs which constitute a set might be purchasable as each single club, such a selling is substantially regarded as a selling of a set.

As mentioned above, the index X and the index Y are considered in the present application. The index X is a value obtained by dividing the loft R (degree) by the length L (inch). In other words, $X=R/L$. The index Y is a product of the depth D (mm) and the height H (mm). In other words, $Y=D\times H$.

As described above, each club has a required performance depending on the club length L (loft angle R). Depending on each club number, a balance between performance for directly aiming at a target and flight distance performance is required. In this respect, when the loft R is great and the length L is small, the index Y is preferably great. That is, as the index X is increased, the index Y is preferably also increased. In this respect, the following [Specification 1] is preferable, and the following [Specification 2] is more preferable.

[Specification 1]: a golf club having X of equal to or greater than 0.1 but equal to or less than 0.9, and having Y of greater than 0 but equal to or less than 25

[Specification 2]: a golf club having X of equal to or greater than 0.25 but equal to or less than 0.8, and having Y of greater than 0 but equal to or less than 25

A request to a club of HB category for directly aiming at a target is further stronger as compared with a club of FW category. In this respect, the categories can adopt respective specifications different from each other. In view of a club of FW category, the following [Specification 3] is more preferable. In view of a club of HB category, the following [Specification 4] is more preferable.

[Specification 3]: a golf club having X of equal to or greater than 0.25 but equal to or less than 0.7, and having Y of greater than 0 but equal to or less than 10

[Specification 4]: a golf club having X of equal to or greater than 0.3 but equal to or less than 0.8, and having Y of equal to or greater than 4 but equal to or less than 10

In view of optimization for each club number, the depth D is preferably as follows.

(1) In a golf club belonging to FW category and having a real loft R of equal to or less than 17°, the depth D is preferably equal to or greater than 0 mm, and more preferably equal to or greater than 1 mm, but preferably equal to or less than 3 mm, and more preferably equal to or less than 2 mm.

(2) In a golf club belonging to FW category and having a real loft R of greater than 17°, the depth D is preferably equal to or greater than 1 mm, and more preferably equal to or greater than 2 mm, but preferably equal to or less than 4 mm, and more preferably equal to or less than 3 mm.

(3) In a golf club belonging to HB category and having a real loft R of equal to or less than 19°, the depth D is preferably equal to or greater than 1 mm, more preferably equal to or greater than 2 mm, and still more preferably equal to or greater than 3 mm, but preferably equal to or less than 5 mm, and more preferably equal to or less than 4 mm.

(4) In a golf club belonging to HB category and having a real loft R of greater than 19°, the depth D is preferably equal to or greater than 2 mm, and more preferably equal to or greater than 3 mm, but preferably equal to or less than 6 mm, and more preferably equal to or less than 5 mm.

In view of optimization for each club number, the index Y is preferably as follows.

(1) In a golf club belonging to FW category and having a real loft R of equal to or less than 17°, Y is preferably equal to or greater than 0, and more preferably equal to or greater than 1, but preferably equal to or less than 4, and more preferably equal to or less than 3.

(2) In a golf club belonging to FW category and having a real loft R of greater than 17°, Y is preferably equal to or greater than 1, and more preferably equal to or greater than 1.5, but preferably equal to or less than 6, and more preferably equal to or less than 5.

(3) In a golf club belonging to HB category and having a real loft R of equal to or less than 19°, Y is preferably equal to or greater than 1, more preferably equal to or greater than 1.5, and still more preferably equal to or greater than 2, but preferably equal to or less than 7, and more preferably equal to or less than 6.

(4) In a golf club belonging to HB category and having a real loft R of greater than 19°, Y is preferably equal to or greater than 2, more preferably equal to or greater than 3, and still more preferably equal to or greater than 4, but preferably equal to or less than 17, and more preferably equal to or less than 15.

EXAMPLES

Hereinafter, effects of the present invention will become apparent according to examples. However, the present invention should not be restrictively construed based on the description of examples.

Example 1

Recess Part in the Front-back Direction

The same head as the head depicted in FIGS. 28 to 32 was produced. A titanium alloy was used as the material of the head. A head body except a face part was produced by lost-wax precision casting. A face member was produced by forging. The obtained head body and the face member were welded to obtain a head of Example 1.

Example 2

Recess Part in the Toe-heel Direction

The same head as the head depicted in FIGS. 1 to 6 was produced. A titanium alloy was used as the material of the head. A head body except a face part was produced by lost-wax precision casting. A face member was produced by forging. The obtained head body and the face member were welded to obtain a head of Example 2.

Examples 3 to 5

Heads of Examples 3 to 5 were obtained in the same manner as Example 2 except the height H was changed.

Comparative Example

The head of Comparative Example was obtained in the same manner as Example 2 except a recess part and a step surface were not provided.

Example 6

The head of Example 6 was obtained in the same manner as Example 2 except the height H and the depth D were changed.

Examples 7 to 11

Heads of Examples 7 to 11 were obtained in the same manner as Example 6 except the depth D was changed.

Examples 12 to 16

Heads of Examples 12 to 16 were obtained in the same manner as Example 7 except the distance T was changed.

Specifications and evaluation results of Examples and Comparative Example are shown in Tables 4 to 6 below. The evaluation results are shown by difference from Comparative Example. When the difference from Comparative Example is slight, the evaluated value is omitted.

TABLE 4

Table 4 Specifications and Evaluation results of Examples and Comparative Example

| | Comp. Ex. | Ex. 1 | Ex. 2 | Ex. 3 | Ex. 4 | Ex. 5 |
|---|---|---|---|---|---|---|
| Extending direction of step surface | no step surface | toe-heel direction | toe-heel direction | toe-heel direction | toe-heel direction | toe-heel direction |
| Height H (mm) | — | 1 | 1 | 2 | 3 | 4 |
| Extending direction of recess part | no recess part | front-back direction | toe-heel direction | toe-heel direction | toe-heel direction | toe-heel direction |
| Depth D (mm) | — | 1 (Maximum value) | 2 | 2 | 2 | 2 |
| Distance T (mm) | — | 10 | 10 | 10 | 10 | 10 |
| Backspin (rpm: against Comp. Ex.) | — | 10 | 50 | 100 | 130 | 150 |
| Launch angle (degree: against Comp. Ex.) | — | 0.1 | 0.1 | 0.2 | 0.3 | 0.4 |
| Coefficient of restitution (Against Comp. Ex.) | — | — | — | 0.001 | 0.002 | 0.003 |

TABLE 5

Table 5 Specifications and evaluation results of Examples

| | Ex. 6 | Ex. 7 | Ex. 8 | Ex. 9 | Ex. 10 | Ex. 11 |
|---|---|---|---|---|---|---|
| Extending direction of step surface | toe-heel direction | toe-heel direction | toe-heel direction | toe-heel direction | toe-heel direction | toe-heel direction |
| Height H (mm) | 1.5 | 1.5 | 1.5 | 1.5 | 1.5 | 1.5 |
| Extending direction of recess part | toe-heel direction | toe-heel direction | toe-heel direction | toe-heel direction | toe-heel direction | toe-heel direction |
| Depth D (mm) | 1 | 2 | 3 | 2 | 5 | 6 |
| Distance T (mm) | 10 | 10 | 10 | 10 | 10 | 10 |
| Backspin (rpm: against Comp. Ex.) | 20 | 80 | 120 | 150 | 160 | 170 |
| Launch angle (degree: against Comp. Ex.) | 0.1 | 0.2 | 0.3 | 0.5 | 0.6 | 0.7 |
| Coefficient of restitution (Against Comp. Ex.) | — | 0.001 | 0.002 | 0.003 | 0.003 | 0.004 |

TABLE 6

Table 6 Specifications and Evaluation results of Examples

| | Ex. 12 | Ex. 13 | Ex. 14 | Ex. 7 | Ex. 15 | Ex. 16 |
|---|---|---|---|---|---|---|
| Extending direction of step surface | toe-heel direction | toe-heel direction | toe-heel direction | toe-heel direction | toe-heel direction | toe-heel direction |

TABLE 6-continued

Table 6 Specifications and Evaluation results of Examples

| | Ex. 12 | Ex. 13 | Ex. 14 | Ex. 7 | Ex. 15 | Ex. 16 |
|---|---|---|---|---|---|---|
| Height H (mm) | 1.5 | 1.5 | 1.5 | 1.5 | 1.5 | 1.5 |
| Extending direction of recess part | toe-heel direction | toe-heel direction | toe-heel direction | toe-heel direction | toe-heel direction | toe-heel direction |
| Depth D (mm) | 2 | 2 | 2 | 2 | 2 | 2 |
| Distance T (mm) | 3 | 5 | 7 | 10 | 12 | 15 |
| Backspin (rpm: against Comp. Ex.) | 10 | 30 | 60 | 80 | 20 | 20 |
| Launch angle (degree: against Comp. Ex.) | — | 0.1 | 0.2 | 0.2 | 0.2 | 0.2 |
| Coefficient of restitution (Against Comp. Ex.) | — | — | — | 0.001 | 0.001 | 0.002 |

Methods for Evaluations are as follows.

[Launch Angle and Backspin]

A golf ball was hit by a swing robot, and the launch angle and backspin were measured. The hitting was made five times for each golf club. The hitting point was set to the face center. Average values of all data were calculated. Differences from Comparative Example are shown in Tables 4 to 6.

[Coefficient of Restitution (COR)]

Coefficient of restitution was measured for each head based on Procedure for Measuring the Velocity Ratio of a Club Head for Conformance to Rule 4-1e, Revision 2 (Feb. 8, 1999) issued by U.S.G.A. Coefficient of restitution at the sweet spot was measured. Differences from Comparative Example are shown in Tables 4 to 6.

As shown in Tables, Examples have higher evaluations than that of Comparative Example. Examples have more backspin, a greater launch angle and a greater coefficient of restitution. Examples have an excellent function, as a club, of directly aiming at a target. From these results, advantages of the present invention are clear.

The present invention can be applied to all golf club heads such as a wood type head, a hybrid type head, and an iron type head. Preferably, the present invention can applied to a wood type head and a hybrid type head.

The description hereinabove is merely for an illustrative example, and various modifications can be made in the scope not to depart from the principles of the present invention.

What is claimed is:

1. A golf club head comprising a crown, a sole, a face, and a hosel, wherein the crown includes:

a front part extending rearwardly from the face to a step surface, a back part having a point on a front end on a surface defining a virtual extension surface, and a recess part, wherein said recess part divides the crown into said front part and said back part between the step surface and the point on the back part, wherein the recess part comprises a bottom surface, a first side surface extending from the step surface to the bottom surface, a second side surface extending from said point to the bottom surface, and at least a part of the recess part extends in a toe-heel direction;

wherein the step surface is positioned above the virtual extension surface of the back part, wherein at least a part of the step surface extends in the toe-heel direction; and wherein the step surface is continuous with the first side surface.

2. The golf club head according to claim 1, wherein a distance T between the step surface and the face ranges from 5 mm through 25 mm.

3. The golf club head according to claim 1, wherein a filler is disposed inside the recess part.

4. A golf club having the head according to claim 1, wherein when the golf club has a length of L inches and a real loft of R degrees, the recess part has a depth of D mm, the step surface has a height of H mm, R/L is defined as X, and D×H is defined as Y, then X ranges from 0.1 through 0.9, and Y ranges from greater than 0 through 25.

5. A golf club head comprising a crown, a sole, a face, and a hosel, wherein the crown includes:

a front part extending rearwardly from the face to a step surface, a back part having a point on a front end on a surface defining a virtual extension surface, and a recess part, wherein said recess part divides the crown into said front part and said back part between the step surface and the point on the back part;

wherein the recess part comprises a bottom surface, a first side surface extending from the step surface to the bottom surface, a second side surface extending from said point to the bottom surface;

wherein the step surface is positioned above the virtual extension surface of the back part of the crown;

wherein the step surface is continuous with the first side surface; and wherein said recess part extends in a front-back direction of the crown, wherein the recess part intersects the step surface.

* * * * *